US012768271B2

(12) United States Patent
Hoehn et al.

(10) Patent No.: US 12,768,271 B2
(45) Date of Patent: Oct. 20, 2026

(54) CARBON FIBER ROCK BOLT

(71) Applicant: CMTE DEVELOPMENT LIMITED, Pinjarra Hills (AU)

(72) Inventors: Karsten Hoehn, Pinjarra Hills (AU); Scott Barnes, Pinjarra Hills (AU)

(73) Assignee: CMTE DEVELOPMENT LIMITED, Pinjarra Hills (AU)

( * ) Notice: Subject to any disclaimer, the term of this patent is extended or adjusted under 35 U.S.C. 154(b) by 16 days.

(21) Appl. No.: 18/283,756

(22) PCT Filed: Mar. 23, 2022

(86) PCT No.: PCT/AU2022/050261

§ 371 (c)(1),
(2) Date: Sep. 22, 2023

(87) PCT Pub. No.: WO2022/198269

PCT Pub. Date: Sep. 29, 2022

(65) Prior Publication Data

US 2024/0175360 A1 May 30, 2024

(30) Foreign Application Priority Data

Mar. 23, 2021 (AU) ..... 2021900850

(51) Int. Cl.

| | |
|---|---|
| ***E21D 20/02*** | (2006.01) |
| ***E21D 21/00*** | (2006.01) |
| ***E21D 21/02*** | (2006.01) |

(52) U.S. Cl.

CPC ..... *E21D 21/006* (2016.01); *E21D 20/02* (2013.01); *E21D 21/0006* (2013.01); *E21D 21/008* (2013.01); *E21D 21/02* (2013.01)

(58) Field of Classification Search

CPC . E21D 21/006; E21D 21/0006; E21D 21/008; E21D 21/02; E21D 20/02

See application file for complete search history.

(56) References Cited

U.S. PATENT DOCUMENTS 3,018,607 A * 1/1962 Dietz ..... D07B 1/0673 57/215
4,650,373 A * 3/1987 Seegmiller ..... E21D 21/004 411/452

(Continued)

FOREIGN PATENT DOCUMENTS

CN 101482024 A 7/2009
CN 107829769 A 3/2018

(Continued)

OTHER PUBLICATIONS

Tanaka, Toru; Machine Translation JPH11131999A; All; May 1999 (Year: 1999).*

(Continued)

*Primary Examiner* — Benjamin F Fiorello
(74) *Attorney, Agent, or Firm* — MARSHALL, GERSTEIN & BORUN LLP

(57) ABSTRACT

A carbon fiber rock bolt including: an outer carbon fiber rope including a series of tow fibers; and an inner core material. As the tension on the rock bolt increases beyond a predetermined limit, the inner core material undergoes a spatial compression, whilst the angle of twist in the carbon fiber rope strands decreases, resulting in extension of the carbon fiber rock bolt, replicating the ductility seen in steel rock bolts.

10 Claims, 24 Drawing Sheets

(56) References Cited

U.S. PATENT DOCUMENTS

| | | | | |
|---|---|---|---|---|
| 5,586,839 | A * | 12/1996 | Gillespie | E21D 21/006 405/259.1 |
| 5,721,047 | A * | 2/1998 | Thicthener | B29C 33/42 264/145 |
| 5,749,681 | A * | 5/1998 | Doidge | E21D 21/0026 405/302.2 |
| 6,560,807 | B1 * | 5/2003 | Stubler | E01D 19/16 428/397 |
| 6,779,950 | B1 * | 8/2004 | Hutchins | E21D 21/0026 57/212 |
| 7,381,013 | B1 * | 6/2008 | Rataj | E21D 21/0033 405/259.5 |
| 8,550,751 | B2 * | 10/2013 | Fox | E21D 21/006 405/259.1 |
| 8,596,923 | B2 * | 12/2013 | Oldsen | E21D 21/0086 405/259.4 |
| 8,746,074 | B2 * | 6/2014 | Lambert | G01D 5/3537 73/152.48 |
| 2005/0042037 | A1 * | 2/2005 | Maltby | E21D 21/008 405/259.4 |
| 2009/0317197 | A1 | 12/2009 | Hinton et al. | |
| 2012/0301228 | A1 | 11/2012 | Taenzer et al. | |
| 2015/0023740 | A1 | 1/2015 | Keller | |
| 2018/0245468 | A1 | 8/2018 | Mesplont et al. | |

FOREIGN PATENT DOCUMENTS

| | | | |
|---|---|---|---|
| CN | 108661683 | A | 10/2018 |
| GB | 2309059 | B | 3/2000 |
| JP | H02115499 | A | 4/1990 |
| JP | H11131999 | A | 5/1999 |
| WO | WO-1996016792 | A1 | 6/1996 |

OTHER PUBLICATIONS

International Search Report and Written Opinion, International Application No. PCT/AU2022/050261, mailed Apr. 29, 2022.

Sicomin Technical Datasheet for SR 8160/SD 815Bx flexible epoxy systems [retrieved from internet on Apr. 20, 2022] <URL:http://http://sicomin.com/datasheets/product-pdf1151.pdf > (2017).

Rock West Composites—How Fiber Direction Influences Tube and Plate Properties [retrieved from internet on Apr. 20, 2022] <URL: https://markets.rockwestcomposites.com/how-fiber-direction-influences-tube-and-plate-properties/> (2022).

Hoehn et al., 'The Design of Improved Optical Fibre Instrumented Rockbolts', Geotech Geol Eng. 2020, vol. 38, pp. 4349-4359.

* cited by examiner

| Requirement | Value |
|---|---|
| Tensile support capability (failure) | 270 kN at 20% extension, |
| Footprint (diameter) of Carbolt | 24 mm |
| Supported grouting methods | similar to current mine-typical installation processes |
| Further desired requirements | •significantly lighter than current standard rock bolts<br>•flexible<br>•not susceptible to corrosion |

FIG. 40

| Typical Property | Units | C T24-5.0/270-E100 | T620SC 24K 50C – AQ854-31 |
|---|---|---|---|
| Number of filaments | | 24k | 24k |
| Fineness of yarn dry | Tex (g/1000m) | 1600 | 1800-1900 |
| Density | $g/cm^3$ | 1.79 | 1.73-1.81 |
| Single filament | $\mu m$ | 6.9 | NA |
| Tensile strength | GPa | 5.0 | min 3.92 |
| Tensile modulus | GPa | 270 | 243 |
| Elongation at break | % | 1.90 | min 1.6 |
| Sizing type | | Epoxy | Epoxy |
| Sizing content | % | 1.0 | 0.8-1.6 |

FIG. 41

| Description | Unit | SGL 24K carbon fiber | | | | |
|---|---|---|---|---|---|---|
| | | 24K | 4 x 24K | 4 Ply | 12 x 24K | 12 Ply |
| Breaking stress Average | GPa | 4.22 | 3.03 | 4.12 | 2.45 | 2.34 |
| | % spec | 84 | 61 | 82 | 49 | 47 |
| Breaking stress Maximum | GPa | 4.65 | 3.57 | 4.38 | 2.56 | 2.56 |
| | % spec | 93 | 71 | 88 | 51 | 51 |

FIG. 42

| Description | Unit | Toray 24K carbon fiber | | | | |
|---|---|---|---|---|---|---|
| | | 24K | 4 x 24K | 4 Ply | 12 x 24K | 12 Ply |
| Breaking stress Average | GPa | 4.07 | 3.24 | 2.87 | 2.40 | 2.17 |
| | % spec | 90 | 72 | 64 | 53 | 48 |
| Breaking stress Maximum | GPa | 4.50 | 3.82 | 3.08 | 2.65 | 2.38 |
| | % spec | 100 | 85 | 68 | 59 | 53 |

FIG. 43

| Carbolt | Tensile strength - max (kN) | % spec | Carbolt Termination | Core | Notes |
|---|---|---|---|---|---|
| **CB-B5-R** | 132 | 28 | Spelter | PE foam | Al bar, CB infused before termination |
| **CB9-R** | 90 | 19 | spelter | Wax | Al bar |
| **CB9-L** | 134 | 28 | Spelter | Wax | Al bar |
| **CB7-L** | 124 | 26 | Spelter | Rigid | Al bar |
| **CB8-R** | (80) | 17 | Spelter | wax | Failed while melting wax |
| **CB6-R** | 93 | 20 | Spelter | Flexible | |
| **CB5-R** | 110 | 23 | Spelter | Semi-rigid | |
| **CB6-L** | 87 | 18 | Spelter | Flexible | |
| **CB5-L** | 126 | 27 | Spelter | Semi-rigid | |
| **CB-B5-L** | 156 | 33 | Spelter | PE foam | |
| **CB-B3-L** | 38 | 8 | Cu wrap | PE foam | |
| **CB-B2-R** | 70 | 15 | Strand clamps | PE foam | |
| **CB-B3-R** | 110 | 23 | Core expansion | PE foam | |

FIG. 44

| | Face gap (mm) | Max shear load (kN) | Core | Complete failure (Y/N) *Notes |
|---|---|---|---|---|
| CB-B2-L | 18 | 19.97 | Foam | No: *Maximum shear displacement reached |
| | 12 | 22.5 | | No: *Maximum shear displacement reached |
| | 6 | 26 | | No: *Maximum shear displacement reached |
| CB10 | 12 | 30.76 | Foam | No: *Maximum shear displacement reached *Loaded axially before shear force applied |
| CB2-L | 12 | 36.86 | Rigid | Almost: *Loaded axially before shear force applied |

FIG. 45

CARBON FIBER ROCK BOLT

FIELD OF THE INVENTION

The present invention provides for systems and methods for providing an improved form of Carbon Fiber Rock Bolt.

REFERENCES

[1] Yves Potvin and John Hadjigeorgiou. Ground support for underground mines. March 2020. isbn: 978-0-9876389 May 3.

[2] Web Page. url: http://shipman.ref.studiotibor.com/technology/carbon-epoxy.asp.

[3] Karl T Ulrich. Product design and development. Tata McGraw-Hill Education, 2003.

[4] Yanyu Chen et al. "3D printed hierarchical honeycombs with shape integrity under large compressive deformations". In: Materials & Design 137 (2018), pp. 226-234.

[5] K. Hoehn et al. "The Design of Improved Optical Fibre Instrumented Rock bolts". In: Geotechnical and Geological Engineering 38.4 (2020), pp. 4349-4359. doi: 10.1007/s10706-020-01246-0.

[6] "Deformation measurement method and apparatus". Australian Provisional US2014902497. 2014.

[7] Roland Verreet. The rotation characteristics of steel wire ropes. Casar Drahtseilwerk, 1997. url: https://www.casar.de/Portals/0/Documents/Brochures/casar-rotation.pdf.

[8] Pinazzi P. C. et al. "Mechanical performance of rock bolts under combined load conditions". In: International

[9] Journal of Mining Science and Technology 30.2 (2020), pp. 167-177. issn: 2095-2686. doi: https://doi.org/10.1016/j.ijmst.2020.01.004.

[10] U. Meir. Arab J Sci Eng (2012) 37:399-411Carbon Fiber Reinforced Polymer Cables.

BACKGROUND OF THE INVENTION

Any discussion of the background art throughout the specification should in no way be considered as an admission that such art is widely known or forms part of common general knowledge in the field.

In general, there is a variety of rock bolts and roof support systems available on the market for mines to choose from. The most common type is the rock bolt, which consists of a metal rod with an anchoring component and a face plate. Some bolts are manufactured out of glass fiber reinforced polymer. They are more expensive than the traditional metal bolt but have special applications, for example on the panel sides of the longwall coal mines to protect the shearer from getting damaged as would occur if metal rock bolts were used.

Rock bolts are the general means of providing roof support and roof stability in underground mining. They are typically made from steel rebar and designed in fixed lengths, with different tensile load limits and therefore provide limited flexibility.

In addition to these fixed-length rock bolts, cable-bolts are available for longer holes and other challenging conditions. The disadvantage of cable-bolts is that, although they have a high tensile strength, they are usually not designed to tolerate sheer stress. Hence, there is a technology gap and a need for a long or deep hole support system which is also tolerant to sheer loads that is also corrosion resistant.

There have been some proposals for the incorporation of carbon fiber into rock bolt systems. For example, Japanese Patent Applications JPH11131999A, JPH02115499A and Chinese Patent Application: CN101482024A disclose various systems of the incorporation of carbon fiber elements into Rock Bolts. However, such systems fail to recognize properties of carbon fibers which provide unique advantages in the utilization in rock bolts.

SUMMARY OF THE INVENTION

It is an object of the invention, in its preferred form to provide an improved form of rock bolt.

In accordance with a first aspect of the present invention, there is provided a carbon fiber rock bolt including: an outer carbon fiber rope comprising a series of tow fibers; an inner core material; and such that, as the tension on the rock bolt increases beyond a predetermined limit, the inner core material undergoes a spatial compression to provide ductile extension of the rock bolt.

In some embodiments, the carbon fiber rope is impregnated with a high extension epoxy resin, wherein the degree of extension of the epoxy resin is up to about 130%.

In some embodiments, the carbon fiber rope includes at least one pressure sensitive optical fiber axially formed in the rope.

Preferably, the inner core includes a series of cavities formed therein. The inner core can include a honeycomb like structure having a series of continuous or semicontinuous cavities. The inner core can be formed from one of a 3D printed or extruded polymer blend, a polymer foam or a displaceable fluid.

Preferably, the fiber can be anchored to a surface using one of a resin capsule, pumpable resin or a mechanical anchor. The bolt can include a tensioning member at one end. The tensioning member can be one of a torque tensioning member, a hydraulic ramp, a rig mast or an expandable foam. The cable can be terminated using either a threaded socket, a wedge locking arrangement or a cable tensioning member.

Whilst the embodiments are described with reference to ground support, it will be evident that the designs have many different applications in civil engineering, including bridge structures and other structures where objects are held in tension.

BRIEF DESCRIPTION OF THE DRAWINGS

Embodiments of the invention will now be described, by way of example only, with reference to the accompanying drawings in which:

FIG. 40 shows a table indicating a functional requirement guide for the Carbolt;

FIG. 41 shows a table indicating the key parameters of the Carbon fiber tows used;

FIG. 42 shows a table indicating tensile test results for SGL carbon tow;

FIG. 43 shows a table indicating tensile test results for Toray carbon tow;

FIG. 44 shows a table indicating Carbolt tensile test results; and

FIG. 45 shows a table indicating Carbolt shear test results.

DETAILED DESCRIPTION OF THE DRAWINGS

Figure 1:
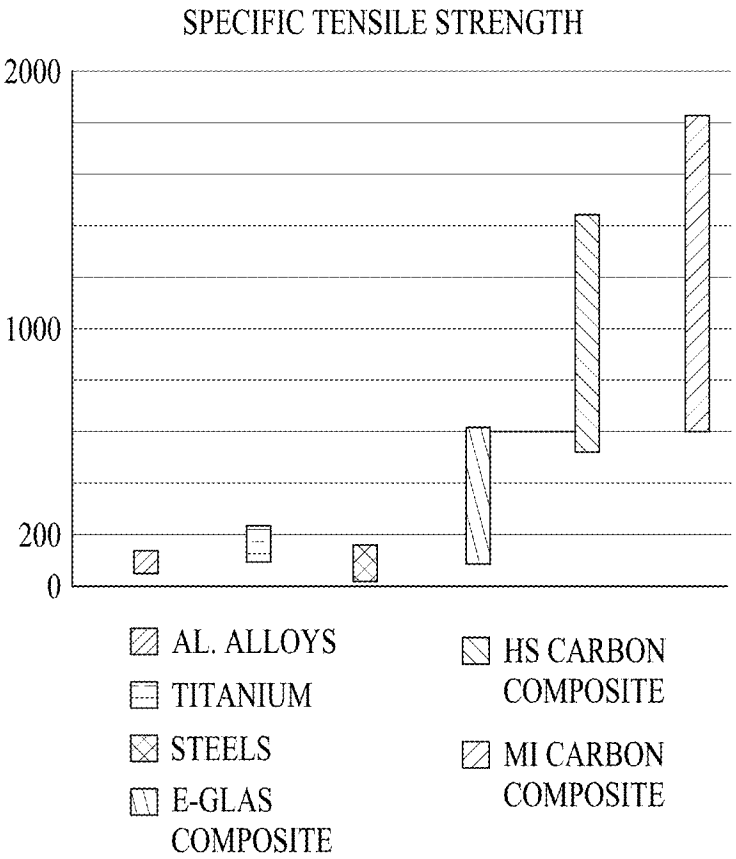
FIG. 1 illustrates a graph comparison of example specific tensile strengths.

The preferred embodiments provide an advanced rock support system in the form of a carbon fiber rope, hereinafter denoted the Carbolt, that can either be manufactured in pre-determined lengths, or in bulk and rolled onto a drum for deployment into a drill hole by a designated machine before being cut to length as needed during the installation.

For single tows the full carbon fiber strength, as specified by the manufacturer, could be achieved when using a high extension (130%) epoxy resin. When four strands of tow were combined by hand the strength was reduced which is indicative of uneven tension in the tow strands, a risk when forming by hand and not seen in commercial pultrusion. The strength reduction in twisted 4 ply was of the same order indicating that the twisting was not impacting significantly on the overall tensile strength. An industrially produced Carbolt at 510 g/m (with a resin fraction of 60%) and 25 mm diameter could have a strength in excess of 400 kN (40 tons).

The Carbolt was also able to withstand significant shear forces. Due to its flexibility, it was able to deform, undergoing a displacement of 30 mm before the shear test box ran out of travel. Further, the ductile behavior, required to release the load stresses in the roof, was demonstrated with a Carbolt containing a modified core.

Twisting significantly longer carbon strands allows uniform pre-tension in all carbon filaments during the twisting and cable forming phases to be achieved, as is routinely done in the production of technical ropes and cables. The Carbolt can also include a unique locking mechanism that locks the carbon fiber strands of the rope without damaging them. This locking mechanism forms part of a new bearing plate design and a number of different designs.

Throughout the duration of an example roadway lifetime, wall and rock movement may be evident, but often not monitored. The ability of integrating optical sensing fibers into the carbon fiber composite structure of the Carbolt enables the monitoring of tensile stresses continuously along the bolt.

INTRODUCTION

The embodiments provide for a carbon fiber rock bolt, in the form of a carbon fiber rope, that can either be manufactured in pre-determined lengths, or in bulk and rolled onto a drum for deployment into a drill hole by a designated machine before being cut to length as needed during the installation. The Carbolt also provides a new locking mechanism that locks the carbon fiber strands of the rope without damaging them. This locking mechanism can form part of a new bearing plate design.

The composite structure of the Carbolt allows the integration of optical fiber sensors into the carbon fiber rope to monitor the tensile stress continuously along the bolt.

The embodiments provide a "coil-able", carbon-fiber based, instrumented rock bolt prototype. That include: the ability to be installed similarly to a cable-bolt; a cable design that offers axial support and shear-load capacity and therefore provides support against lateral rock movement; the ability to undergo ductile extension prior to ultimate failure; the design of a Carbolt locking mechanism, which can be pre- and re-tensioned, with the load bearing plate; and an optical fiber sensor, integrated into the rope during the manufacturing stage, to enable the ability for monitoring of rock movements.

A carbon-fiber based rock bolt will be able to endure a higher tensile load than a comparable diameter or weight steel rock bolt. The carbon-fiber structure allows ductile extension of the Carbolt to occur at a predetermined tensile loading, prior to reaching its breaking load. The use of carbon-fiber eliminates corrosion problems occurring with metal bolts and the associated degradation of the roof support system, and therefore extends the lifetime of the support system. Resin, injected after fiber assembly is set in place, offers improved interfacial bonding between fiber and rock substrate, improving tensile and sheer performance. The integration of fiber optic sensors allows monitoring of tension strain continuously along the bolt, enabling geo-technical engineers to assess the effectiveness of the support system and get early warning of localized movement throughout the Carbolts service life.

The Carbolt installation procedure can be simple, especially in cases where the rock formation requires different length of rock bolts and/or a combination of rock bolts and cable bolts, as all cases can be serviced by the Carbolt. Only a minimal mass needs to be handled by the operator as the Carbolt is lighter than steel and also can be coiled up on a drum and cut to length during the installation.

The Carbolt, that is designed as an improved and advanced roof support and strata control system, has, by its very nature, the potential to improve the underground safety dramatically. These benefits arise from the fact that a carbon-fiber-based strata control system can be expected to tolerate much higher loads than comparable sized steel products, while not being susceptible to material fatigue from corrosion. On top of the enhanced load capacity a Carbolt can be expected to be significantly lighter than a steel support system. This is expected to reduce the number of injuries and health issues caused by the manual handling during the installation of the support system. Instrumented roof support systems are already available on the market. However, typically they have to be installed separately as they don't provide a support function, and therefore slow down the roadway development process, and/or they are only installed at a limited number of locations throughout the mine, which limits the accuracy of the geo-technical assessment. Having a sensor system integrated into the standard roof support system during the manufacturing process will offer the possibility to monitor the integrity of the strata control system throughout the entire mine, providing a full geo-technical picture of the mine. Even if circumstances change, e.g. through earthquakes or other activities outside the current mine working area, no additional monitoring needs to be installed.

Technology Review

Roof support systems for mining applications are typically manufactured from High-Tensile Steel, and in some circumstances from Fiber-Glass composite materials. However, materials with much higher specific tensile load capacities are available nowadays, see FIG. 1, and there is an opportunity to apply this technology to the mining industry.

The embodiments include a carbon fiber anchor. Traditionally, carbon-fiber structures are known for their high tensile load capacity, exceeding comparable steel structures as shown in FIG. 1, but also for being brittle and abrupt failure. In the embodiments, a new anchor was designed to have a ductile phase and initial trials demonstrate that a carbon fiber structure can display ductility prior to failure under tension.

Figure 2:
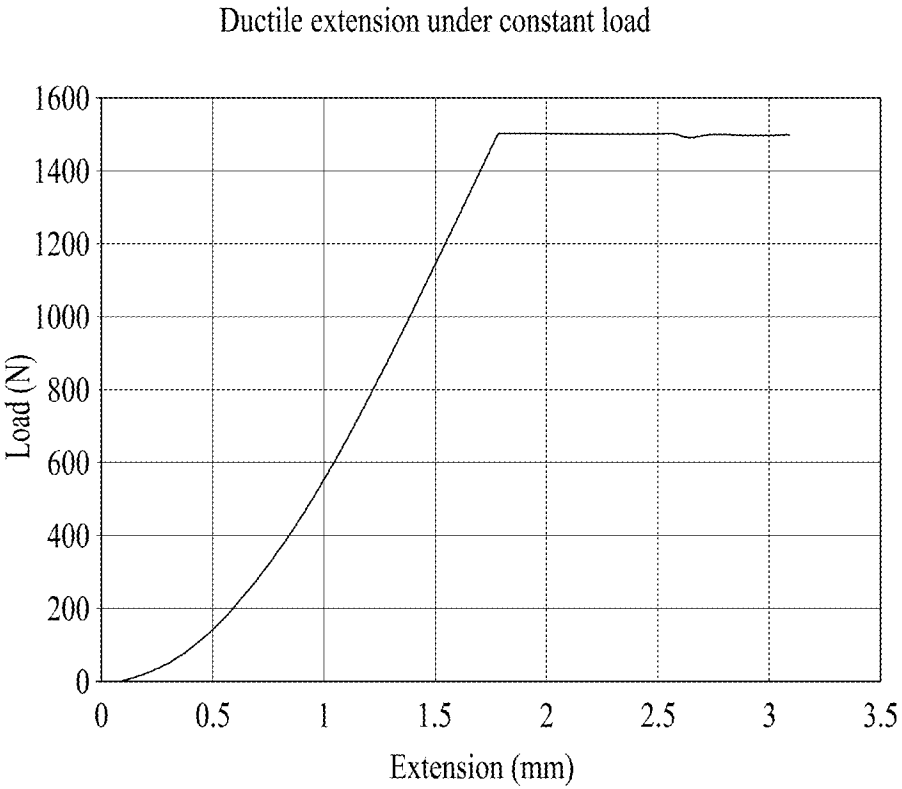
FIG. 2 illustrates an example of ductile extension of a carbon fiber anchor.

For example, FIG. 2 illustrates the extension of a carbon-fiber sample anchor with 10 mm in diameter. The carbon-fiber structure can be modified during manufacture process to provide a ductile mode of failure rather than the typical sudden failure normally expected from carbon fiber composites.

Figure 3:
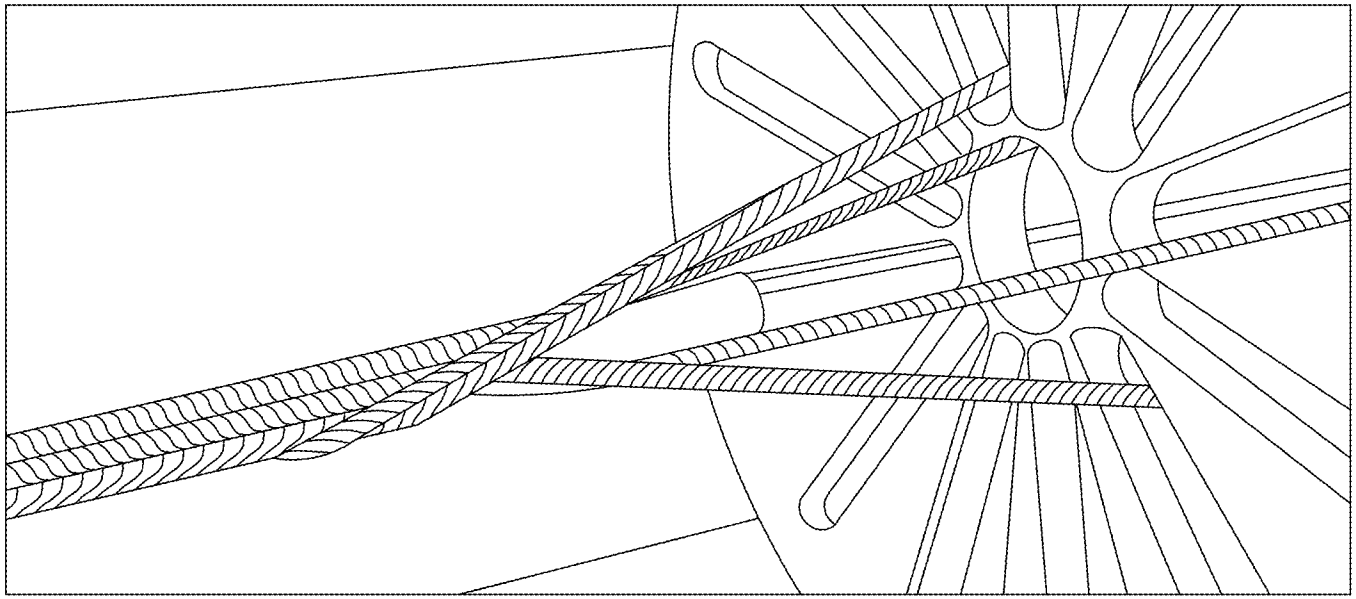
FIG. 3 illustrates a rope twister.
Figure 4:
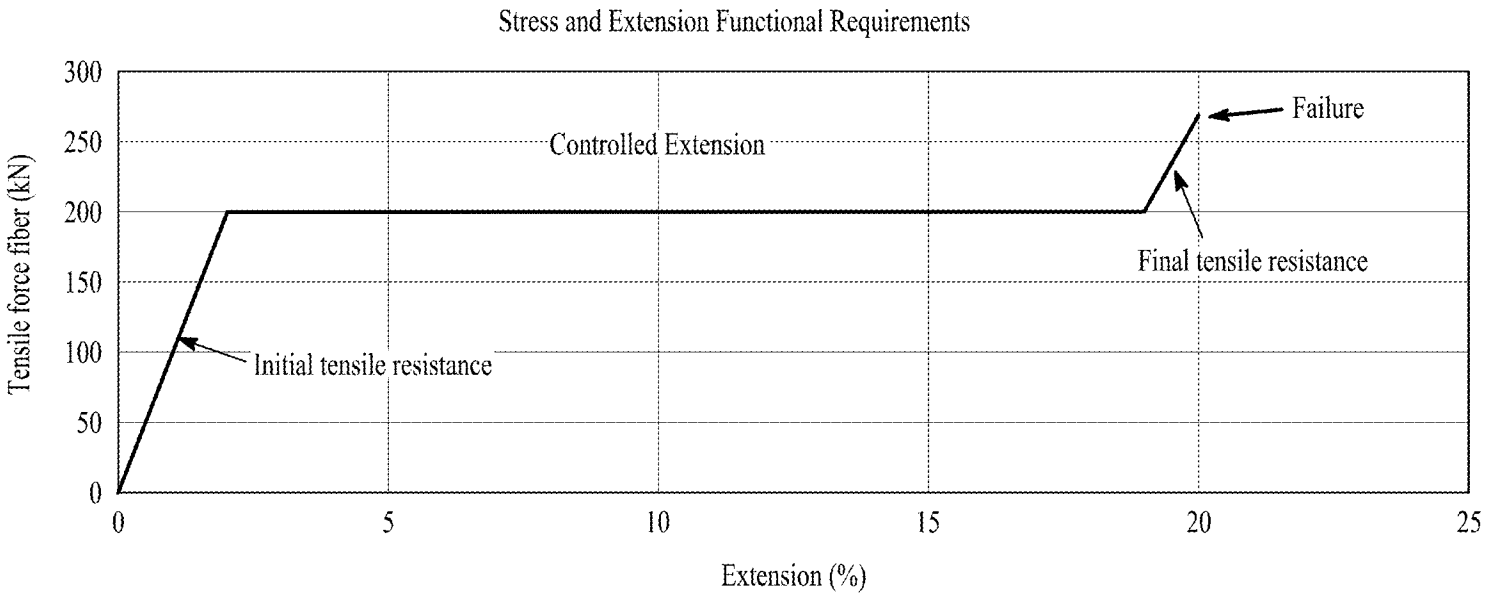
FIG. 4 illustrates a Carbolt force and extension relationship illustrating the four main behaviors.

The carbon fiber anchor can be initially created using a twisting machine, such as that shown in FIG. 3. The machine is preferably able to manufacture twisted cables from carbon fiber tows of various sizes. A fiber tow is a bundle of fibers with typically between 1-thousand and 50-thousand individual filament fibers. The ductility can be achieved and regulated through introduction of a collapsible core into the carbon fiber cable assembly.

Carbolt Concept Development

The Carbolt is an engineering system which is made up of different, inter-connected components These include the carbon fiber, the core, any integrated sensors, assembly, anchoring of each end and termination.

A system-level concept exploration process was performed to gain a better understanding of the key functional components, the risks, unknowns, technology gaps and research questions; and the interconnections and overall complexity of the Carbolt system. This understanding was then used to focus the sub-components concept development phase and the experimental proof of concept phase. The functional requirements and concept development process is described in the following sections.

Functional Requirements

A Carbolt needs to be light-weight, corrosion resistant and flexible. The values provided in FIG. 40 were used as a guide for developing the Carbolt concept solution. The Carbolt is desired to allow for approximately 20% of extension in the rock mass before failure. This extension consists of four main behaviors: 1. an initial tensile resistance (up to roughly 200 kN of force with an extension of between 5% and 10%); 2. a controlled extension (core collapse) where the Carbolt allows for an extension of between 5% and 15% at around 200 kN; 3. a final tensile resistance of up to 270 kN and between 15% and 20% extension; and 4. a failure at or above 270 kN. These behaviors are illustrated in FIG. 5.

A technology exploration process was followed to develop a matrix for the Carbolt concept. The exploration considered various technologies and methodologies for: 1. anchoring of the Carbolt in the hole; 2. the design of the cable; 3. tensioning of the Carbolt; and 4. termination of the Carbolt. Other performance criteria include: the ease of the installation of the component, the ease to manufacture the component; the cost of the component; and the risk or difficulties to realize the component.

Hole Anchor Method

Figure 5:
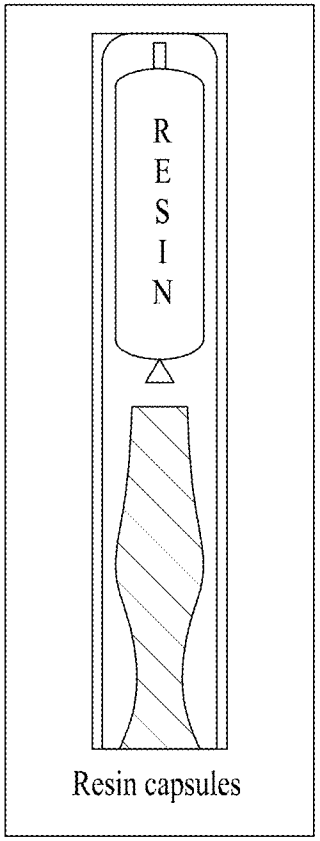
FIG. 5 to FIG. 7 illustrate various fixing arrangements.
Figure 6:
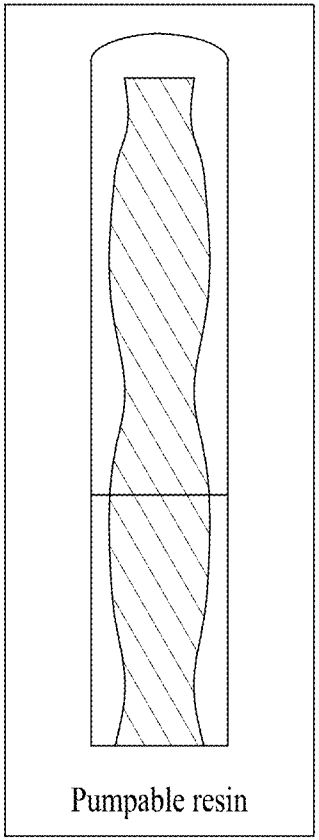
Figure 7:
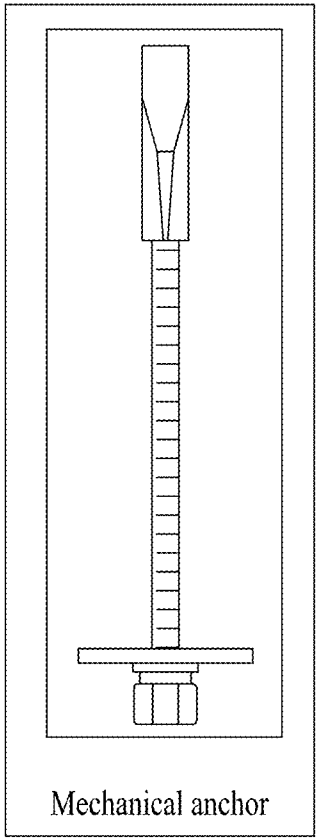

A number of different anchoring methods were considered as illustrated in FIG. 5 to FIG. 7. In FIG. 5, standard resin capsules ("sausages") could be used to either resin or grout the Carbolt in. For this to work the Carbolt tip will need to be hard enough to penetrate the capsule. Further, the "Carbolt string" needs to be stiff enough so that it can be spun around to mix the two components in the capsule.

In FIG. 6, a pumpable resin or grout option is provided which could be injected through the Carbolt, provided the Carbolt is equipped with a hollow core. This approach might require the development of new resin or grout formulations.

In FIG. 7, a mechanical anchor, e.g. expansion bolt, could be used to lock the Carbolt tip in place. However, given the Carbolt is designed to be flexible it is expected this will be difficult to realize without additional installation tools.

Cable Design

A number of cable designs options were considered, with reference to FIG. 8 to FIG. 11.

Figure 8:
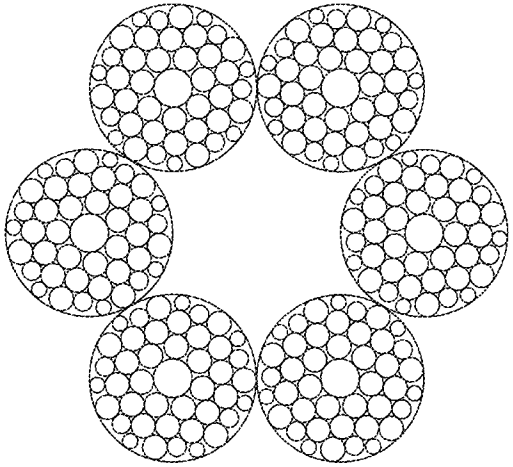

For example, in FIG. 8, the cable or rope of the Carbolt could be supplied as dry Carbon Fibers, wrapped around a solid core. However, handling dry fibers bears risks associated with damage to the fine fibers and possible skin irritation. Further, fully saturating the dry fiber with resin in the hole presents a difficult engineering task.

Figure 9:
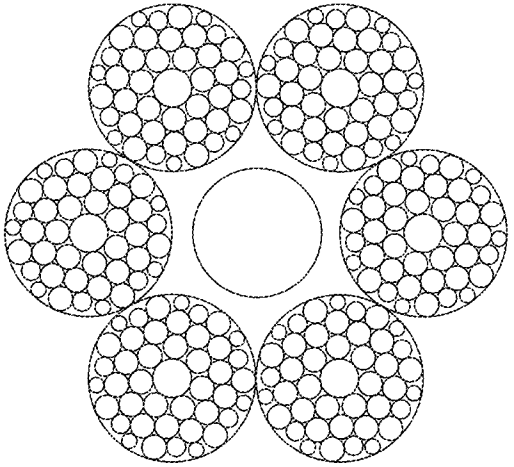
FIG. 8 to FIG. 11 illustrate various cable winding arrangements.

As illustrated in FIG. 9, instead of wrapping the carbon fibers around a solid core a hollow core could be used to enable the injection of resin or grout during the installation. Considering that the core needs to be collapsible to allow the ductile extension of the Carbolt, keeping an opening, or a collapsible center if a resin or grout plug hardens within the hollow core, will provide an engineering challenge.

Figure 11:
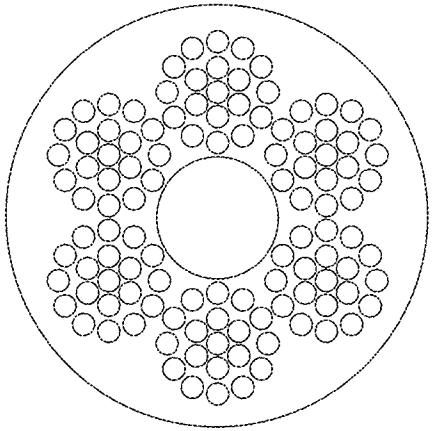
Figure 10:
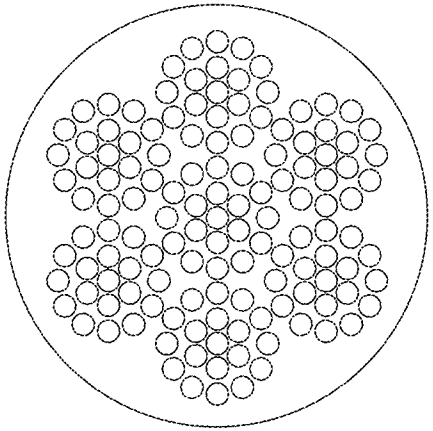

As illustrated in FIG. 10, alternative to dry fibers, the carbon rope could be manufactured from resin pre-impregnated fibers, which will remove the risks associated with dry fiber handling. However, a resin with high extension needs to be used rather than the typical carbon fiber resins that are brittle and very inflexible. As illustrated in FIG. 11, similar to the dry hollow core an encapsulated hollow core could be utilized, which will entail the same engineering challenges as mentioned above.

Tensioning Methods

Figure 12:
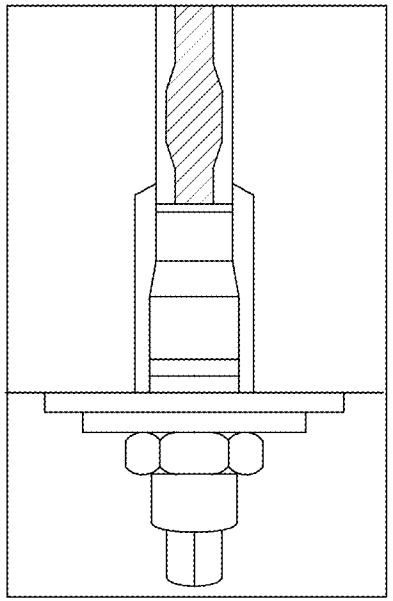

A number of tensioning methods were considered. For example, as shown in FIG. 12, a torque tensioning mechanism would provide a simple method to tension and re-tension the Carbolt, provided the cable or rope can be terminated in a free-spinning, threaded ferrule.

Figure 13:
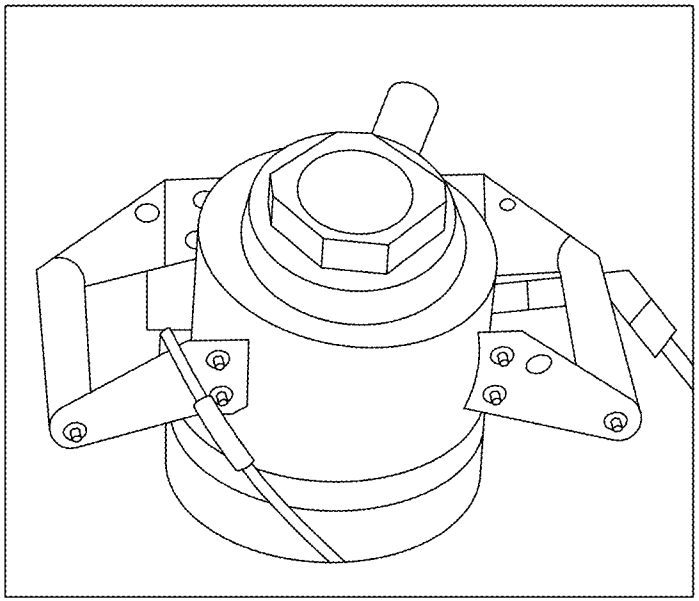

As shown in FIG. 13, hydraulic ramps are typically used to tension steel cable bolts. However, the gripper mechanism would need adaptation to avoid damaging the carbon fiber rope.

Figure 14:
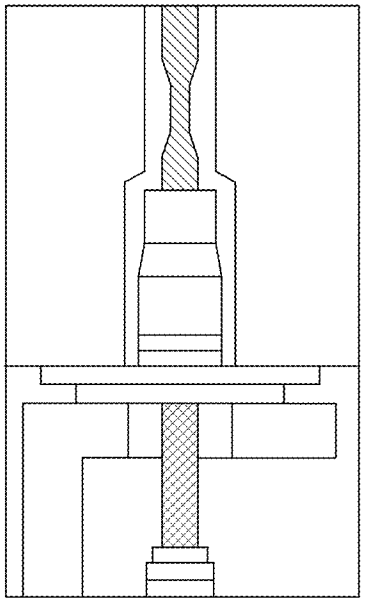
FIG. 12 to FIG. 14 illustrate various tensioning arrangements.

As shown in FIG. 14, a tensioning method often used in the US is the roof compression utilizing the rig mast prior to tightening the bolt nut and then "expanding" the roof again. However, this method seems to be unpopular in other countries.

An expandable foam could be pumped into the Carbolt rope. As the foam expands it will increase the diameter of the rope and at the same time shorten the rope in accordance to Poisson's ratio. While this principle is simple it is expected to be difficult to achieve a reproduceable tensioning value. Further, this method does not allow re-tensioning and will be difficult to combine with a hollow core.

Similar to the expandable foam, a pressurized core could be realized by pumping it up with mine water, or similar. It is expected that the pressure could be better controlled than the chemical reaction causing the foam to expand. Sealing the Carbolt rope against pressure losses will present an engineering challenge, but provided the Carbolt is equipped with a pressure valve it would be possible to re-tensioning the bolt.

For a Variable Length Carbolt system, where the Carbolt rope is reeled off a wheel, the wheel could be wound back once the anchor is set in place to pull the rope and tension the Carbolt.

Carbolt Termination Methods

Many cable termination methods were also considered, with particular consideration to not crush the fiber core. These methods include encapsulated sleeves (known for carbon fibers) and socket encapsulation (known for cable bolts), but also more flexible, i.e. easier to re-tension, arrangements like wedge sockets and wedge and collar methods. Other options investigated included swaged sleeves and thimble methods as well as various forms of cable grip types.

Several potential realizations of the different Carbolt key components are listed and explained in the sections above. While there are many possibilities to combine those different methods, three Carbolt concepts are explained here exemplarily in more detail.

Figure 15:
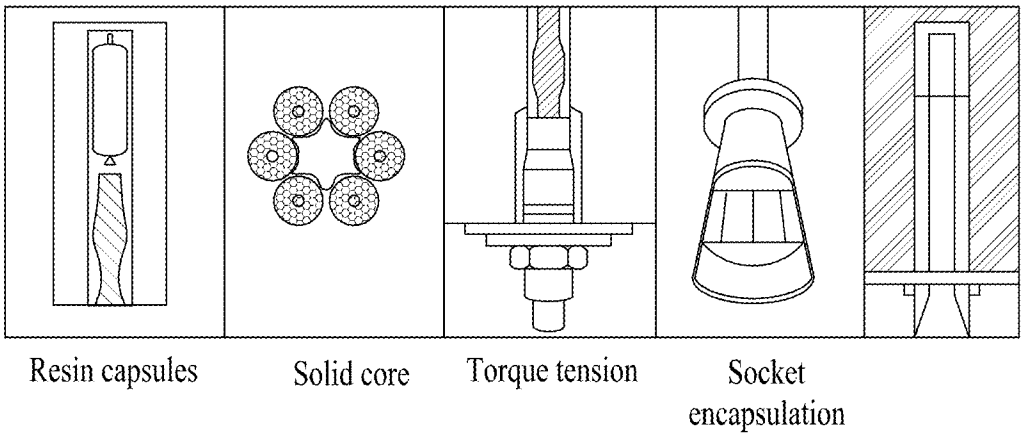
FIG. 15 illustrates one possible realization of the Carbolt concept utilizing resin capsules for the cable anchoring, a solid core, torque tensioning and socket encapsulation.

Concept 1: Carbolt Concept Utilizing Resin Capsules for the Cable Anchoring, a Solid Core, Torque Tensioning and Socket Encapsulation As illustrated in FIG. 15, the concept 1 uses socket encapsulation as a method for terminating the Carbolt. The socket is machined with an external thread which allows for tensioning by applying torque to a nut (similar to current rock reinforcement practices). The current concept is envisaged to be used with resin capsules; however, it can be modified to support other methods. Socket termination is currently used to terminate similar systems and is therefore expected to be a low-risk solution relative to the other concepts. This solution is also likely to be a relatively low-cost, easy to install and easy-to-manufacture solution. It is expected that this solution would not be suitable for in-situ fiber construction due to the resin termination procedure.

Concept 2: Carbolt Concept Similar to Concept 1 but Utilizing a Wedge Socket

Figure 16:
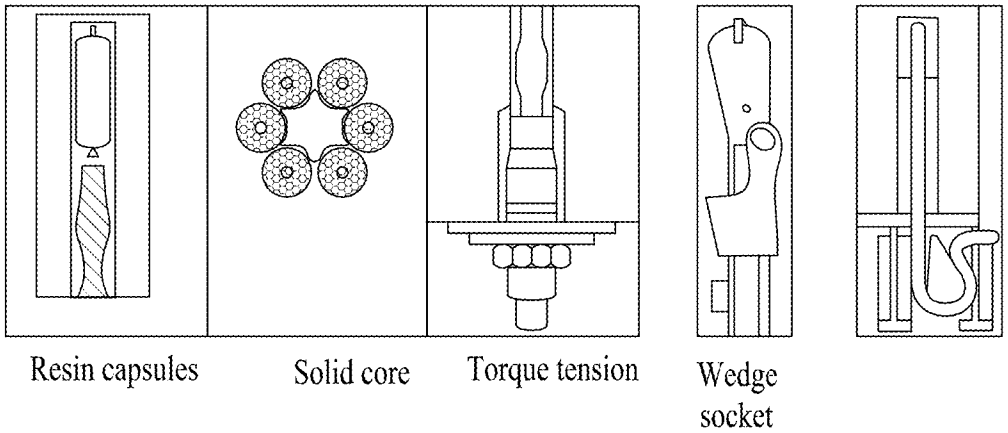
FIG. 16 illustrates another possible realization of the Carbolt concept similar to the one in FIG. 15 but utilizing a wedge socket instead of socket encapsulation.

FIG. 16 illustrates the concept 2. The wedge-locking socket concept was provided due to its ability to support the cutting and termination of the Carbolt in-situ. The concept uses a wedge-locking termination method. The cable can be inserted into the hole through a wedge-locking assembly. A wedge is then inserted into wedge-locking assembly to terminate the Carbolt. Tension can be applied by applying torque to bolts located on each side of the wedge-locking assembly. This concept is not expected to be as cost-effective, low-risk, easy to install and easy to manufacture as the threaded socket concept. The value of this concept is, however, in its ability to allow the Carbolt to be cut to any length and terminated in-situ.

Figure 17:
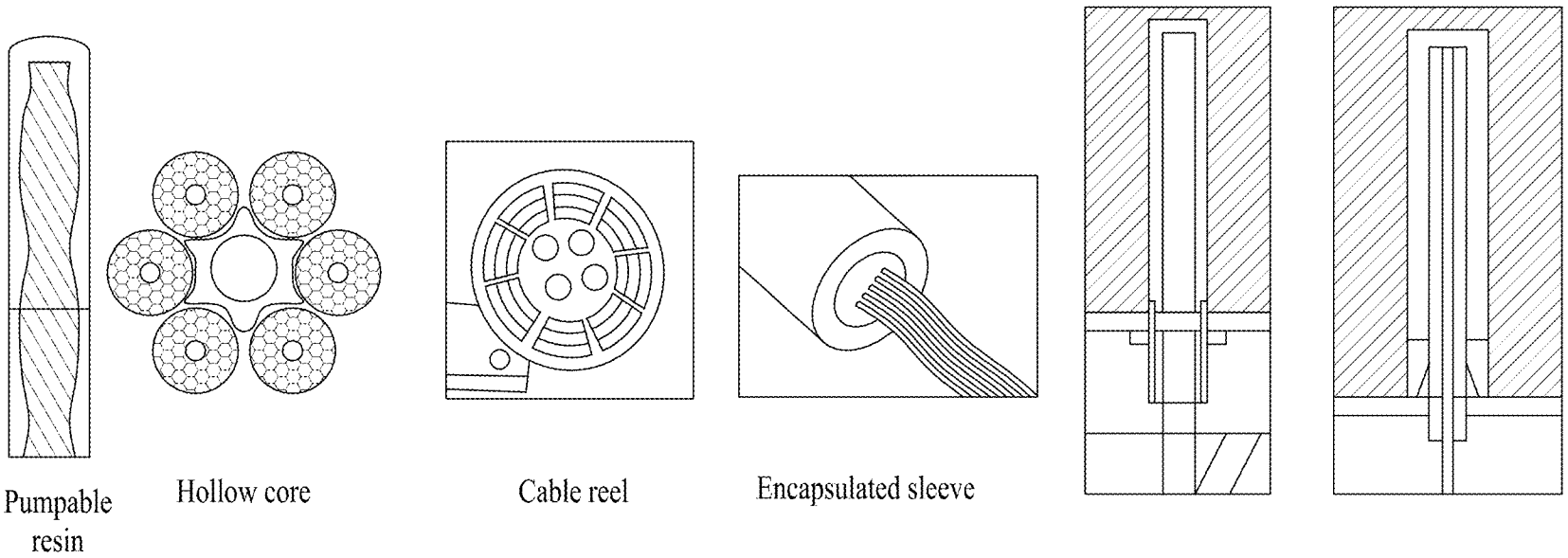
FIG. 17 illustrates another possible realization of the Carbolt concept utilizing a pumpable resin for the cable anchoring, a hollow core, a cable reel to deploy and tension the cable and an encapsulated sleeve for cable termination.

Concept 3: Carbolt Concept Utilizing a Pumpable Resin for the Cable Anchoring, a Hollow Core, a Cable Reel to Deploy and Tension the Cable and an Encapsulated Sleeve for Cable Termination The third concept illustrated in FIG. 17. This solution supports the drum-deployable Carbolt concept and uses different types of pumpable resin. This concept involves deploying the Carbolt into the hole using a cable-reel. Resin is pumped into the hole to retain, encapsulate and the terminate the Carbolt. The termination socket is designed such that resin can be pumped through it to encapsulate and terminate the Carbolt. Pre-tensioning can be performed by applying a load to the rock face prior to curing of the resin or by using quick setting resin (at the distal end of the Carbolt) and applying tension using the cable drum or another tensioning method. This solution supports the ability for in-situ customized length rock bolt construction and is expected to be a relatively low-cost, easy to install and easy-to-manufacture solution. The main challenge with this solution is the risks associated with the pumpable resin.

Concept Exploration Summary

The concept exploration process produced a number of concept solutions. It was found that the interconnections between all of the Carbolt components, the pre-tensioning requirements, the type of resin/encapsulation and the desire to determine the rock bolt length in-situ has a large impact on the final concept solution. For example, the pre-tensioning method or ability to construct variable length Carbolts (requiring specific installation procedures) may limit or restrict the termination methodology and resin type.

Component-Level Concept Development

The following sections provides details relating to key components of the Carbolt.

The Carbon Fiber Strands

The carbon fiber in a carbon fiber composite is the primary load bearing element with the resin matrix functioning to transfer load between adjacent carbon fibers in the structure. Maximum tensile strength is obtained by running all carbon fibers parallel within the structure, which also maximizes packing density and hence the specific strength of the structure. This is typically achieved by a pultrusion process. Fiber (filament) winding and roll wrapping processes produce rods and tubes that have a lower ultimate tensile strength but that can tolerate higher torque, compression and deflection without splitting. Pultruded glass fiber composites rock bolts are available but exhibit no ductility prior to failure. The Carbolt structure was conceived to address this, with all carbon fibers orientated at an angle around a functional core. Two alternate structures considered, being either a multilayer braid or a multi-strand laid cable.

The Carbolt Core

The key functions of the Carbolt core are to: provide a semi-rigid structure on which the twisted carbon fiber strands are laid; provide compressive and torsional rigidity to penetrate and mix resin capsules (if used); provide infrastructure for services such as resin, grout, return air, etc.; and collapse, allowing the Carbolt fiber angle to decrease and hence the Carbolt length to extend at a predetermined load giving a ductile-like response to increasing tension prior to reaching maximum load and ultimate failure.

Figure 18:
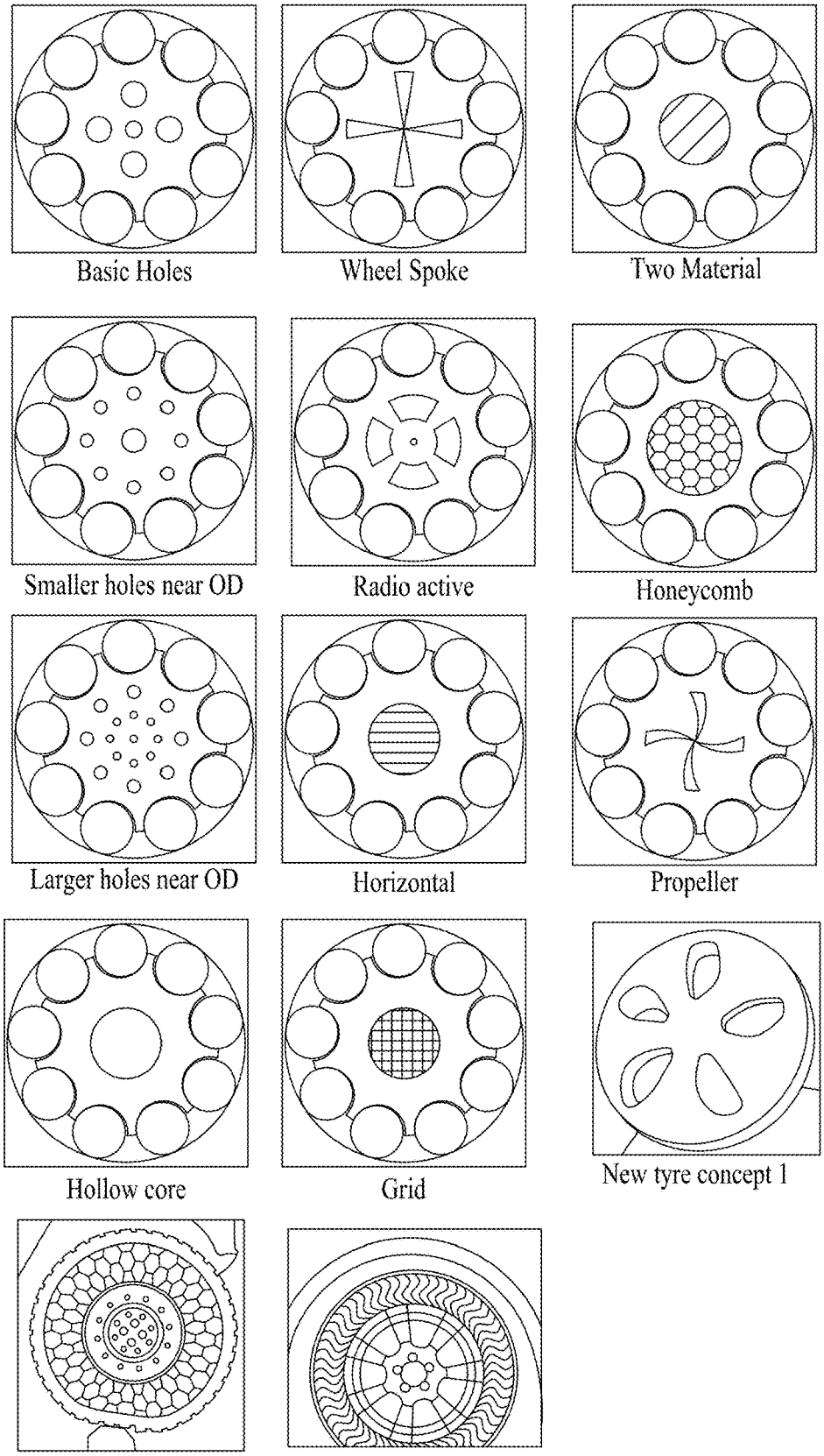
FIG. 18 illustrates a Snapshot of potential Carbolt core designs.

As illustrated in FIG. 18, a technology review and concept exploration process was performed to identify suitable core concepts. A total of 14 potential core concepts were identified. The following performance criteria were considered during the concept exploration process: the ability to provide torsional pliability; the ability to provide tensile pliability; the ability to provide compressive pliability; and the complexity or manufacturability.

Recent developments in additive manufacturing techniques have enabled many new design capabilities in terms of design geometry and material properties. There are therefore many different potential concept solutions. Of the many potential inner-core structures investigated, the honeycomb structure was particularly appealing. Honeycomb structures have a relatively high compressive resistance and can be designed to collapse at a constant rate. [4].

Encapsulation/Grouting

Figure 19:
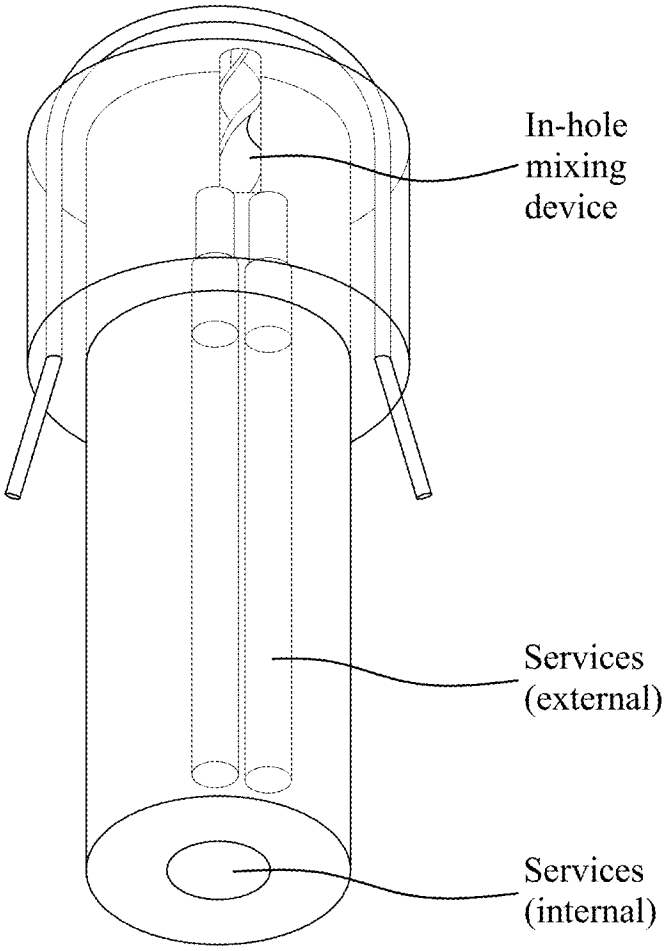
FIG. 19 illustrates an example of internal and external services delivery concepts.

Depending on retention and termination method, the Carbolt may need to provide the infrastructure required for various types of services such as grout, resin, instrumentation and displaced gas. Resin-based solutions may also require some form of mixing which could potentially be performed in the hole. Services can be delivered to the hole internally or externally to the Carbolt structure. The hole and Carbolt diameter would have to be considered to support the infrastructure required for these services. FIG. 19 illustrates various ways in which these concepts could be realized.

Hole Retention

Figure 20:
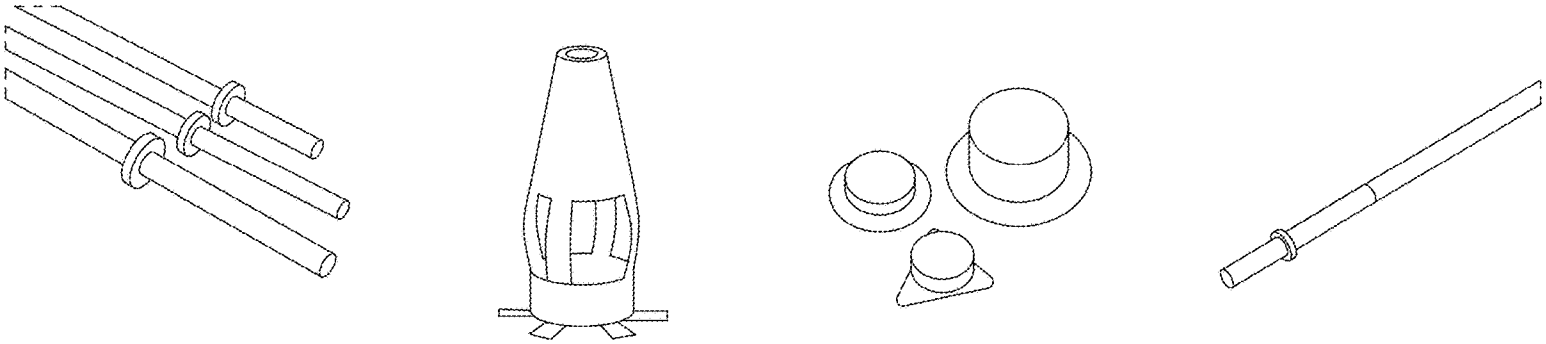
FIG. 20 illustrates Minova Quick-Chem™ Lokset™ resin capsule insertion accessories.
Figure 21:
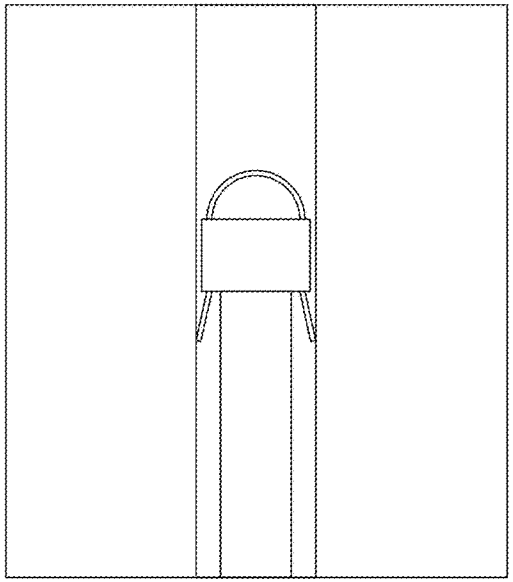
FIG. 21 illustrates simple wire lock as potential Carbolt centering accessory.

The Carbolt may need to be inserted and retained in the hole to assist the installation process. There are a variety of different commercial solutions available for inserting and retaining resin capsules in the hole (shown in FIG. 20). These retention methods can be adapted to suite the Carbolt design. A simple wire-locking method that will retain and center the Carbolt during the installation process is shown in FIG. 21.

Integrated Sensor

Figure 22:
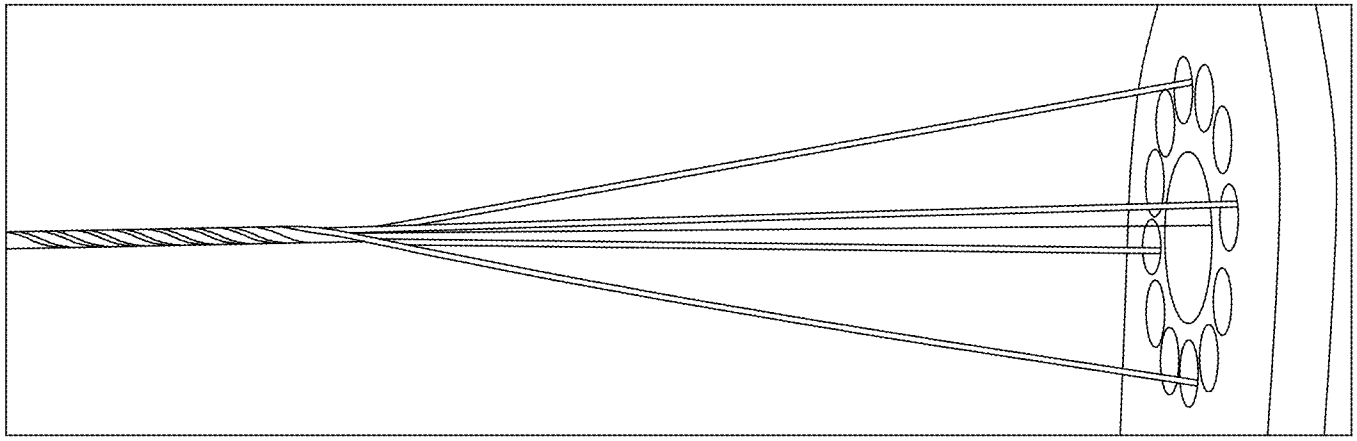
FIG. 22 illustrates an orange sensor fiber is being integrated into the Carbolt.

One alternative embodiment of the Carbolt includes an integrated sensing system, enabling geo-technical engineers to evaluate the effectiveness of the roof support system. Traditionally, electrical strain gauges have been used for this purpose, however they have quite a number of disadvantages as laid out in [5]. Optical fibers on the other hand provide the opportunity to integrate a distributed sensor, covering the entire length of the bolt at high spatial resolution, without altering the bolt structurally. An optical fiber can therefore be integrated and twisted into the Carbolt structure as can be seen in FIG. 22.

Through the winding process the optical fiber will end up in a helical formation along the Carbolt. This sensor design is similar to that disclosed in Australian patent application: 2015283817, entitled 'Deformation measurement method and apparatus', and corresponding U.S. patent application No. 20180171778.

Anchoring and Termination Methodology

Three potential anchoring and termination methods were identified in the system-level concept exploration phase. Further details associated with each of the methods are described below.

Threaded Socket Concept

Figure 23:
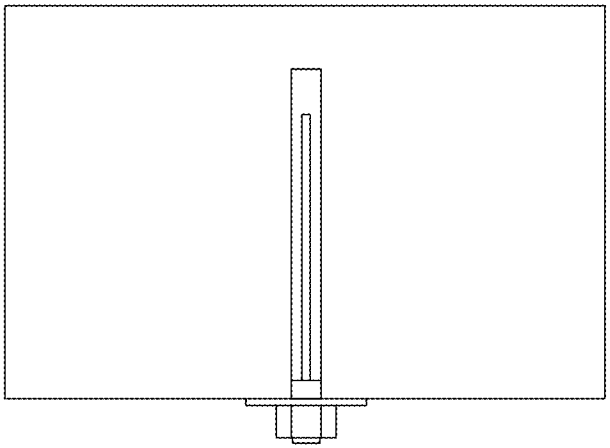
FIG. 23 is an illustration of the threaded socket concept showing the (left) toque nut in blue.
Figure 24:
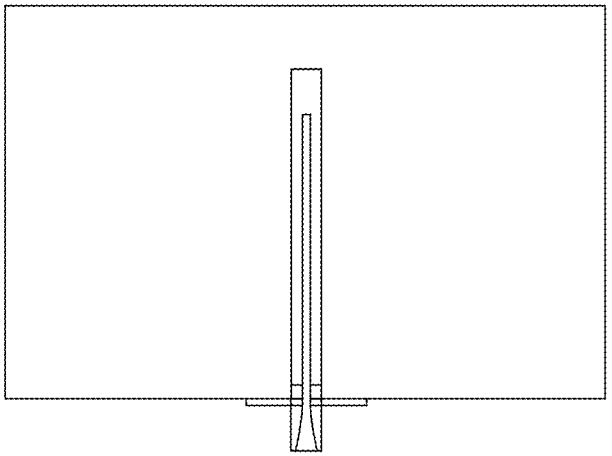
FIG. 24 illustrates a section view of the threaded termination socket in red

This concept works by encapsulating the end of the Carbolt in a termination socket prior to or during the installation process. The socket encapsulation starts by brooming or flaring the Carbolt strands within a tapered socket. The broomed strands are then set in the socket using a high modulus potting resin. As tension is applied to the Carbolt, the resin and broomed fiber are wedged into the taper applying a clamping force to the strands to augment the interfacial resin/fiber bond. This concept uses an externally threaded socket assembly allowing pre-tensioning and retention by applying torque to the nut. An illustration of the threaded socket concept is shown in FIG. 23 and FIG. 24.

Figure 26:
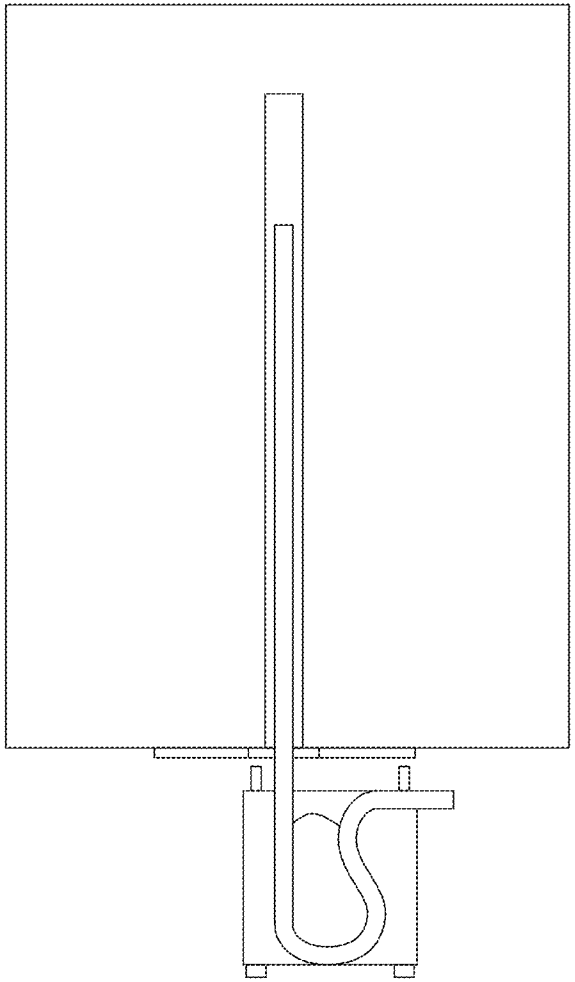
FIG. 26 illustrates a sectional view through the arrangement of FIG. 25.
Figure 25:
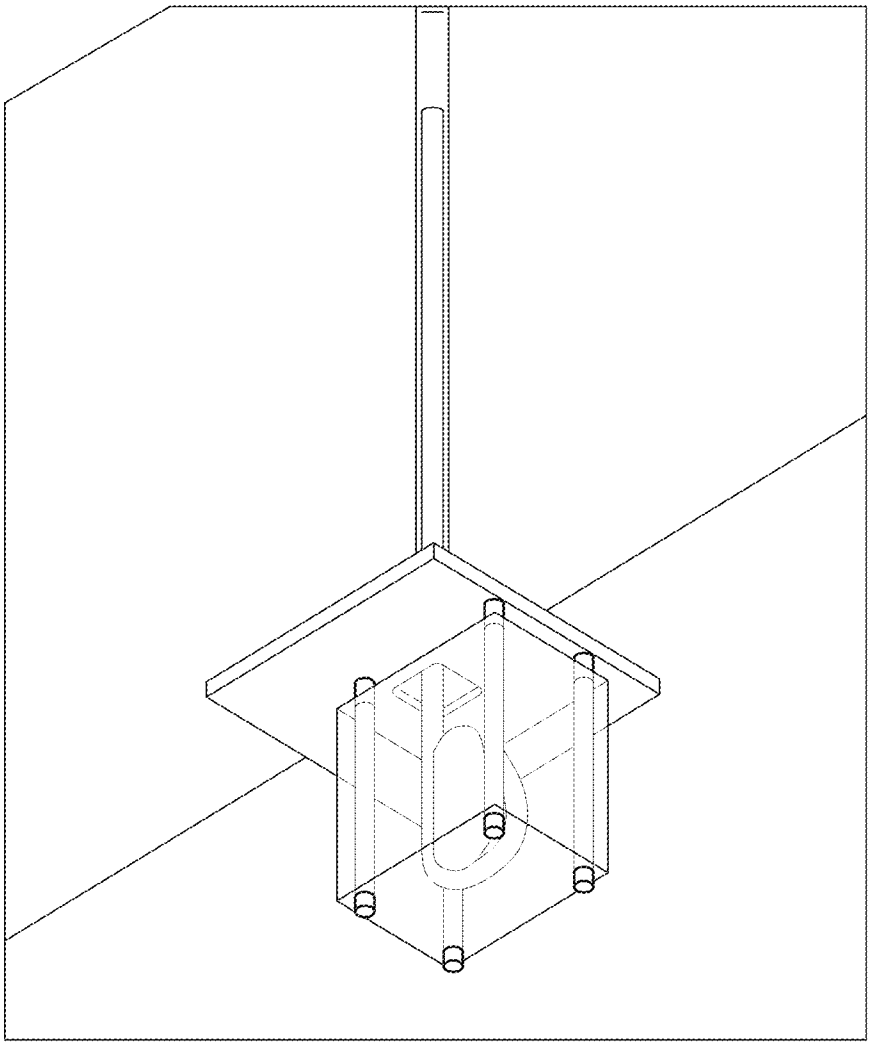
FIG. 25 is an illustration of the wedge-locking concept showing the (left) wedge-locking assembly in red and the wedge in blue

Some key attributes of this concept include: simpler design, supports various forms for encapsulation/grouting and point anchoring, supports the use of both internal and external delivery services, may require the Carbolt to be cut and terminated prior to installing at the work site, The Wedge-Locking Concept This concept works by terminating the Carbolt using a wedge-locking method in-situ. The Carbolt is fed through a washer plate into the drilled hole and cut to the required length. The fiber is then routed through a wedge-block and terminated using a wedge-locking system. As tension is applied to the Carbolt, the wedge insert is wedged into the housing applying a clamping force to the Carbolt structure. The Carbolt is pre-tensioned by applying a torque to bolts on each corner of the wedge block assembly. An illustration of the extendable wedge-locking concept is shown in FIG. 25 and FIG. 26.

Figure 28:
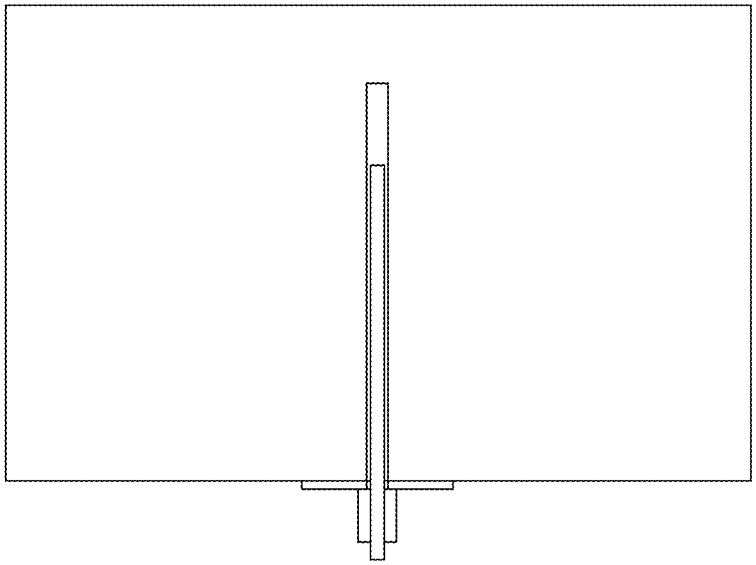
FIG. 28 illustrates a section view showing the termination socket in red.
Figure 27:
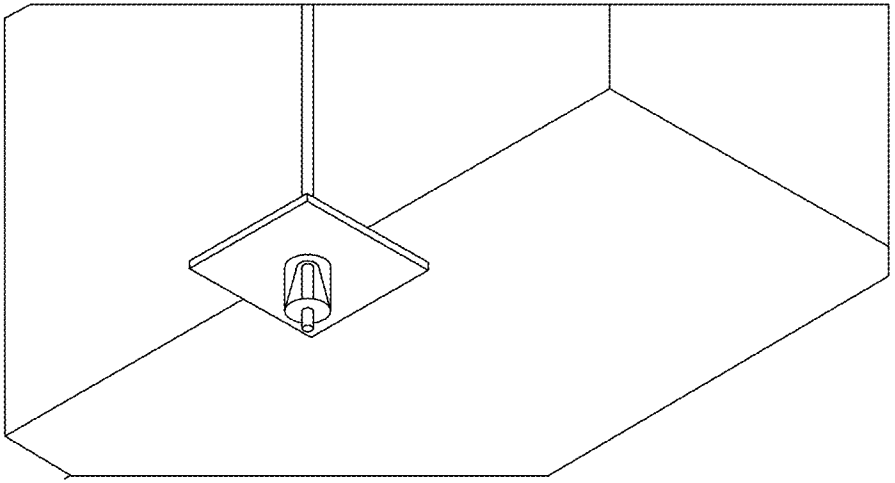
FIG. 27 illustrates a cable-tension assembly.

Some key attributes of this concept include: a more complex design, supports the in-situ cuttable Carbolt, may limit methods of encapsulation/grouting and point anchoring due to the use of the wedge block, and may require longer installation times due to the use of the wedge block The Cable-Tension Concept This concept is illustrated in FIG. 27 and FIG. 28. This concept works by deploying the Carbolt using a cable drum. The reel is unwound, feeding the cable through a termination socket and the washer plate into the hole. Resin is then pumped into the center of the Carbolt or through the termination socket and into the cavities between the Carbolt and rock mass. The resin encapsulates the fiber and fills the socket cavity (effectively terminating the Carbolt).

Some key attributes of this concept include: a simple design with relatively low complexity, supports the use of both internal and external delivery services, supports the in-situ cuttable Carbolt concept, is likely to result in faster installation times, development of the pumpable resin may introduce additional engineering and research development requirements.

Component-Level Testing

This section describes the development and design of the proof-of-concept version of the Carbolt components and includes the outcomes from validation studies. The objective of the proof-of-concept was to demonstrate the ability of the Carbolt to withstand the high tensile and shear loads as well as demonstrate a ductile like force-extension relationship.

A prototype simplified version of the threaded socket concept was constructed. It was expected that this solution would be a suitable solution to achieve the objectives of the proof-of-concept phase. This section provides details relating to components of the proof-of-concept design.

Carbolt Fiber and Resin Matrix

There are five broad types of carbon fiber. As tensile strength increases modulus decreases so a choice needs to be made based on the properties required and cost over alternative materials. This includes Ultra-high-modulus, type UHM (modulus >450 Gpa), High-modulus, type HM (modulus between 350-450 Gpa), Intermediate-modulus, type IM (modulus between 200-350 Gpa), Low modulus and high-tensile, type HT (modulus <100 Gpa, tensile strength >3.0 Gpa), Super high-tensile, type SHT (tensile strength >4.5 Gpa).

For Carbolt, tensile strength is of primary importance, weight is not critical, and a commercial application would be highly price sensitive. Therefore, intermediate modulus carbon fiber tows were evaluated. The second criteria considered was tow count, that is the number of carbon fiber filaments in the carbon fiber tow. High count tows are more cost effective when comparing price per kilogram of carbon and also reduce the number of strands that need to be twisted (or braided) together to form the final Carbolt. Three high count tows were trialed, 12K, 25K and 50K. The tow count being the number of carbon fiber filaments in the tow, 12K for example being a tow with 12,000 filaments. Initially, a 25K tow was chosen for the initial Carbolt.

The choice of resin matrix is even boarder than the carbon fiber options, and in many commercial applications is specifically formulated for the end use. A resin system for the Carbolt needed to meet two main criteria. The first was that it had to be compatible with the carbon fiber, that is to say, it had to match the sizing used on the carbon fiber during tow manufacture. Most carbon fiber produced is sized with an epoxy and are generally not compatible with polyurethane and polyester resins. This is a disadvantage as epoxy resins are typically more expensive and normally have very low extension. The Carbolt resin matrix also needs high extension for the Carbolt is to achieve the desired performance in terms of shear strength and ductility. Other resin formulations can also be used.

For this work a single epoxy resin system was used. The epoxy chosen was unique having an extension of over 130% (where most epoxies used in the carbon fiber industry have an extension of <3%). Unfortunately, it had a very slow rate of cure, but this was tolerated for this initial work.

Carbolt Core

Two simple core concepts were considered in the initial design. The first approach, illustrated in FIG. 29, was based on an additive manufacturing process (3D printing) and the second was based on a closed cell polyethylene foam core with a thin coat of a brittle (low extension) epoxy. In both cases a simple core provided a semi-rigid structure on which the carbon fiber strands were twisted and allowed the Carbolt structure to collapse/extend at a predetermined load to allow for relative rock mass movement before failure.

Figure 30:
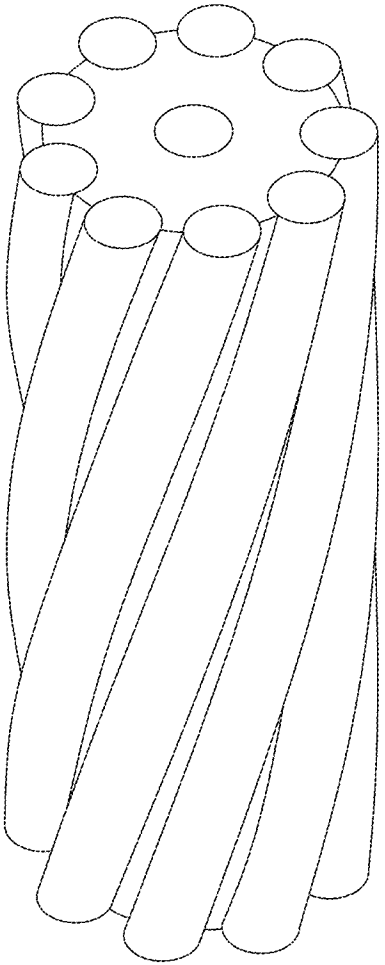
FIG. 30 illustrates the 3D printed Carbolt core with the Carbolt strands seated along the outer diameter of the core.
Figure 29:
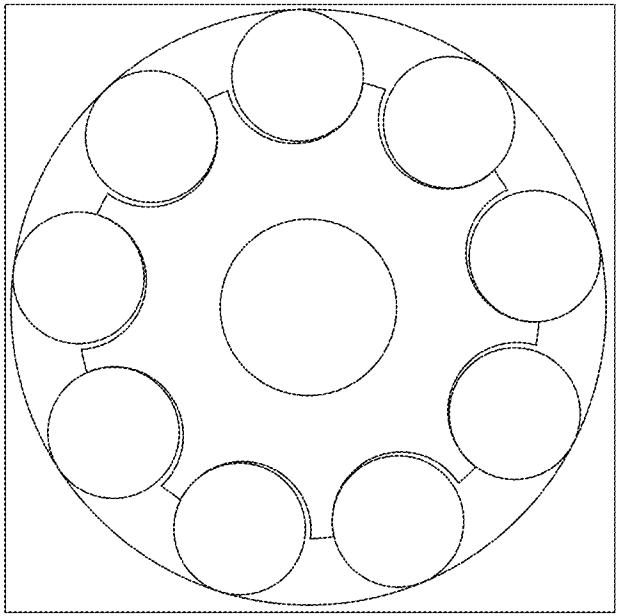
FIG. 29 illustrates a simple core design used in the 3D-printed core concept.
Figure 32:
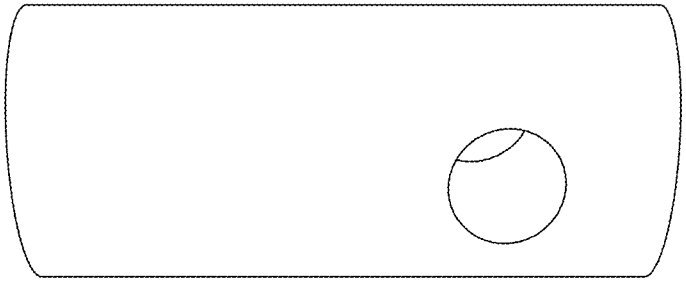
FIG. 32 illustrates a Custom socket design.
Figure 33:
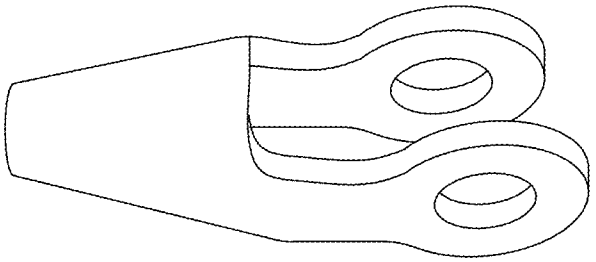
FIG. 33 illustrates a commercial termination socket.

The 3D printed core, as per FIG. 29, was designed with nine helical grooves (5 mm diameter) running along the outer 18 mm diameter of the core. The grooves allowed for the seating of the carbon fiber strands during the manufacturing process. A 5 mm diameter void was included in the center of the core. It was envisaged that the following behaviors would occur: 1. an initial tensile resistance as the twisted carbon strands bear the load and the core material supports the compressive force induced by tension on the twisted carbon strands; 2. an extension of the Carbolt as the wall of the core fails and is compressed into the void in the center and the angle of twist in the carbon strands decreases; 3. a secondary tensile resistance as the core becomes fully collapsed and the load continues to be taken up by the now straighter Carbolt strands; and 4. eventual failure of the structure as the Carbolt strands fail. The Carbolt core design is illustrated in FIG. 30.

Figure 31:
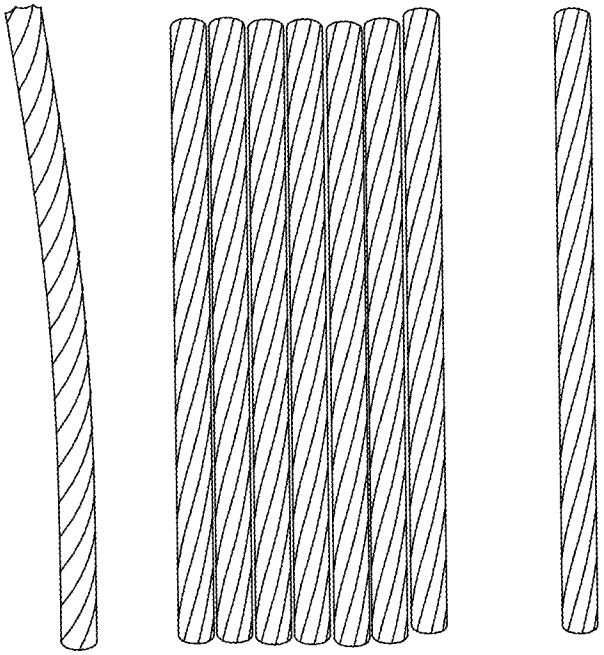
FIG. 31 illustrates different Carbolt cores printed with different mechanical properties. Cores on the left are more flexible and cores on the right are more stiff.

The 3D printed cores were manufactured using Fused Deposition Modelling (FDM) technology. This method allowed for the blending of different materials to achieve different mechanical properties including tensile strength, elongation at break, shore hardness and tensile tear resistance. Of particular interest, was the shore hardness which can be relatable to the stiffness of a material. Nine initial cores were printed with varying material properties as shown in FIG. 31 to demonstrate this concept. Three cores consisting of a rigid, semi-rigid and flexible material were printed for lab-based proof-of-concept testing.

Termination

A socket termination method was used to terminate the Carbolt on each end as this method is currently used to terminate various types of fiber-based ropes and was envisaged to be a relatively low risk solution compared to other methods. Furthermore, this solution provided flexibility in terms of critical dimensions and potting material. Initial tests used a custom designed socket but the socket internal taper in conjunction with the potting Resin Used Proved Unable to Sustain the Required Load. a Commercially Available Socket Used for terminating wire cables was used successfully with both high compressive strength polyester and epoxy resins loaded with fine abrasive particles (silica or garnet respectively). Other example resins can be found in [10].

Carbolt Manufacturing

Figure 34:
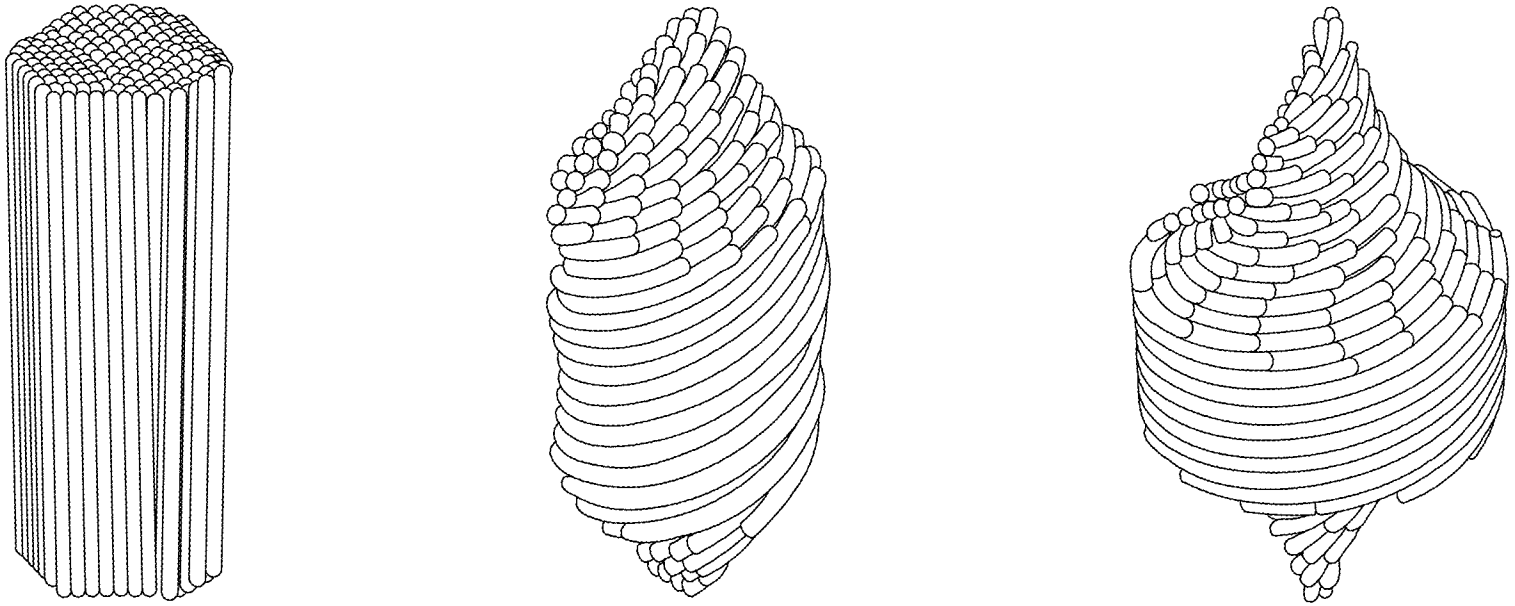
FIG. 34 illustrates modelled filament paths in pultruded and twisted structures.

The angle of twist of the carbon fiber tow, plies and strands is important to ensuring all carbon fiber filaments see the same loading when the Carbolt is placed under tensile of shear loading as well as when the Carbolt undergoes ductile extension prior to ultimate failure. In a pultruded fiber rock bolt, all fibers in the structure are linear as in the first schematic in FIG. 34 and should be exposed to the same load (if terminated well). It is also important to maintain a uniform path length in a wrapped (twisted or braided) structure to ensure that all fibers in the structure bear the same load when under shear or tensile load. Examples of this are shown in the second and third schematic of FIG. 34.

Figure 35:
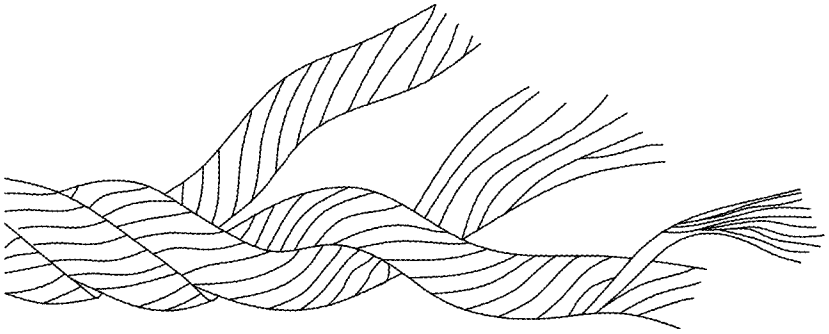
FIG. 35 illustrates multi-ply laid cable structure.

Variation in filament path lengths in a twisted cable can be reduced by building up the cable strands from smaller twisted sub-units described as "plies" and illustrated in FIG. 35.

Figure 36:
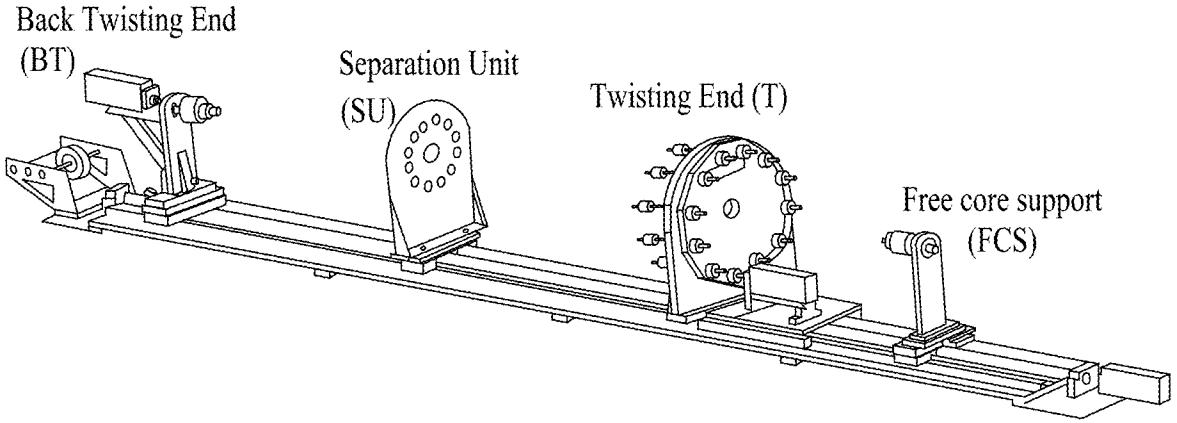
FIG. 36 illustrates a Schematic of a pilot twister.

To balance the torque induced by twisting essentially inelastic filaments it is necessary alternate the direction of the twist that is inserted into the ply. The pilot twister was designed to twist from two up to twelve primary strands in either S or Z (clockwise or anti-clockwise) direction and back-twist (twist in the opposite direction) the twisted primary strands either simultaneously or independently of inserting the primary twist. The number of turns of primary and back-twist can be independently programmed while strand tension is maintained during twisting using a counterweight. The absolute tensile load applied can be varied by altering the mass of the counterweight. FIG. 36 illustrates an example twister. Hence the twister can produce multi-lay cables by building up intermediate ply strands and to make cables with or without a core. The bed length was two meters.

Materials Used in Carbolt

Carbon tow: The primary carbon fiber used for the Carbolt trials was SGL's Sigrafil C T24-5.0/270-E100, a 24 k (24-thousand filament) continuous filament carbon fiber tow. This is an intermediate modulus carbon fiber equivalent to the industry standard T300 from Toray, see FIG. 41. The 24K was selected out of 12, 24 and 50K option after initial trials to determine the heaviest count ('thickest") carbon tow that could be reliably twisted to form the multi-ply twisted strands needed for laying around a core forming a twisted carbon fiber cable, the Carbolt.

Core: As previously described two different cores were used, 3D printed cores with three variations of an Agilus30 polymer blends giving different compressive strengths and an epoxy coated closed cell polyethylene foam core. At the end of trials when it became apparent that neither core was performing as desired a more controllable paraffin wax core was used for a couple of Carbolts and the data from this core is also reported.

Infusion Resin

Sicomin SR8160/SD 815 B2 resin/hardener system was chosen for its very high elongation at break at greater than 130% (typical elongation for epoxies used in carbon composites is less than 3%).

For the Carbolt to display ductile-like extension under tensile load, it is desired for the Carbolt core material to reduce in volume at a predetermined load. A number of different core material were used, selected for their different compressive strengths. The 3D printed cores have been described above in detail. Three cores were selected from the range of compressive strength/flexibilities produced to test the maximum Carbolt extension. To maximize the reduction in core volume a small number of Carbolts were made with a 13 mm diameter closed cell foam core which could give a volume reduction of over 90%. To increase the foam cores initial compressive strength these cores were coated with a brittle epoxy resin. A 0.7 mm brittle shell was formed using 30 g of West Systems 105/205 epoxy mixed with 5 mL of glass micro-spheres (to increase its viscosity to facilitate rotary coating) per linear meter of the core.

A small number Carbolts with wax cores were also produced with the aim of more clearly demonstrating the ductile performance that could be achieved as the other cores where not optimized in this work for compressive strength.

Resin impregnation of a carbon fiber structure is ideally achieved by forcing a resin flow through the fiber within a mold or other constraining system. The force can be supplied by vacuum or pressure (or a combination). For this work vacuum infusion offered the simplest route to achieving a high fiber/resin fraction while minimizing voids (air bubbles leading to resin matrix discontinuities through the structure). Both a custom silicone mold and more traditional vacuum bagging were tried but failed due to the degree of fiber compaction in the twisted strands making it difficult to get complete infusion of the bolt prior to the resin starting to gel. Therefore, a wet layup was used without pressure or vacuum assistance.

Potting Carbolt Terminations and Carbon Fiber Tow Tabs

Tabs are generally used to terminate carbon tows and small diameter plies for mounting in hydraulic jaws of a tensile testing frame. Testing of tows and plies was done according to ASTM D4018 using West System G-Flex epoxy resin and glass microspheres to increase the viscosity. The same resin was used (without microspheres) to pot the Carbolt in the custom termination sockets but this was not able to withstand the load applied. Wirelock, a commercial polyester potting resin from Millfield Enterprises UK, designed for steel cables was tested in conjunction with steel cable spelters. This involved using a locally produced epoxy potting resin, Kinetix R246 epoxy resin with H160 hardener and loading it with the same weight fraction of fine garnet (80 mesh hard rock garnet) as the silica found in the Wirelock product. This was also successful so used for all tests with the wire spelters.

Carbolt Performance

A Carbolt was created as a carbon cable made from 108 strands of 24K carbon tow, constructed as 9 twisted plies or strands of carbon twisted around a core, where in turn each of the 9 strands are themselves built up from the original 24K carbon tow by twisting four strands of the 24K tow then back-twisting (to maintain torque balance) three of these 'four-ply' strands to make one of the nine 12-ply strands that are twisted around the core.

The example structure is thus: 4×24K tows twisted in to a "four-ply", 3×four-ply twisted in to a '12-ply', 9×12-ply twisted around a core to produce the final 9-strand laid Carbolt.

Figure 37:
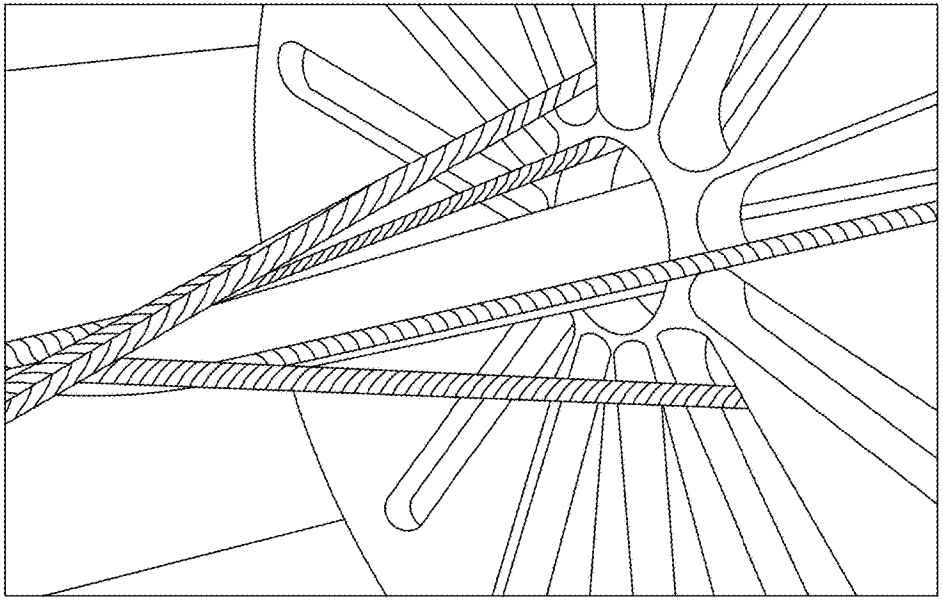
FIG. 37 illustrates back-twisting 9 strands of 12-ply CF around 3D printed core.
Figure 38:
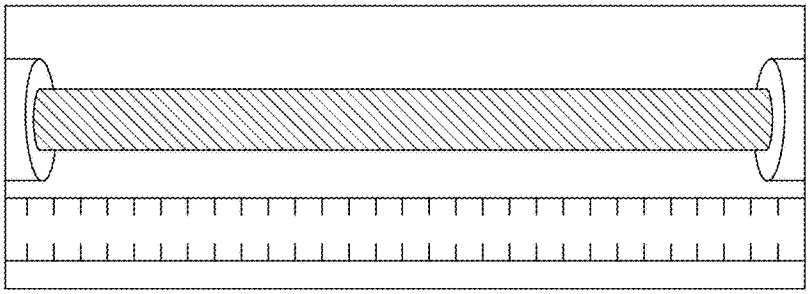
FIG. 38 illustrates a Carbolt with custom termination sockets ready for testing.

An example structure is illustrated in FIG. 37 and FIG. 38. Because the structure is built up sequentially as described above it was possible to test the tensile performance of samples of each of the 4 ply and 12 ply structures independently from the Carbolt, and compare the results with composites constructed from the same number of aligned carbon fiber tows ("tow tests") and as twisted carbon fiber composites ("ply tests"), the results of which are summarized in FIG. 42 and FIG. 43.

These component tests established that: The high extension resin system used for the Carbolts did not adversely impact on the manufactures stated performance (which is tested with a low extension resin, typically <5% extension compared to the resin used in this work with an extension >130%). It is difficult to get all fibers evenly tensioned when preparing lab scale structures, hence as the number of tows combined increases the measured tensile performance reduces to nearly 50% of the expected result when combining 12 tows whether the fiber is aligned or twisted. This is thought to be an artefact of the production scale, not of the structure per-se. It was possible to show minimal reduction in tensile strength caused by twisting a small number of plies.

Tensile Performance of Carbolt Components

Tensile test results for SGL carbon tow and Toray carbon tow are shown respectively in FIGS. 42 and 43.

Tensile strength performance of Carbolt design (9×12ply with different cores of 12 mm Ø)

As seen in the tensile results shown in FIG. 44 for the four and twelve tows as well as the plies above and due to the complexity of manual manufacturing of the multi-stranded carbon fiber composites the specific strength achieved actually decreases as more tows are added. This also happens when nine strands of the 12-ply strands are twisted and wrapped around the cores to form the Carbolt. As a result, the tensile strengths for the Carbolts is significantly less than expected, with the best result being only 33% of the strength that would be obtained from a commercial pultrusion of this number of tows. Despite these low results, there is sufficient evidence in the series below and the component tests to indicate that if made commercially, where tow tensions can be accurately managed during cable construction, 80-90% of the pultruded composite strength could be achieved. This would produce a Carbolt at 510 g/m (with a typical resin fraction of 60%) and 25 mm diameter with a strength in excess of 400 kN (40 tons). Shear strength Various Shear Tests were Conducted as Shown in FIG. 45.

Ductility

A Carbolt core needs to withstand the transverse compressive load induced by the twisted carbon helix under tension until the Carbolt reached 70-80% of its ultimate strength. The structure of the Carbolt, the twisted helix around a core that could undergo a change in volume did however allow the principle of controlled extension under load to be demonstrated. Where a linear fiber array, as is found in a pultruded carbon composite, would have an extension of 1-1.5% the 9 strand Carbolt with a helix angle of 15% tested in this project had an extension of 3.2% with the rigid core, 5.1% with the semi-rigid and 6.5% with the wax core (after melting the wax). The desired extension can be engineered by altering the core properties and volume and the strand helix angle.

Figure 39:
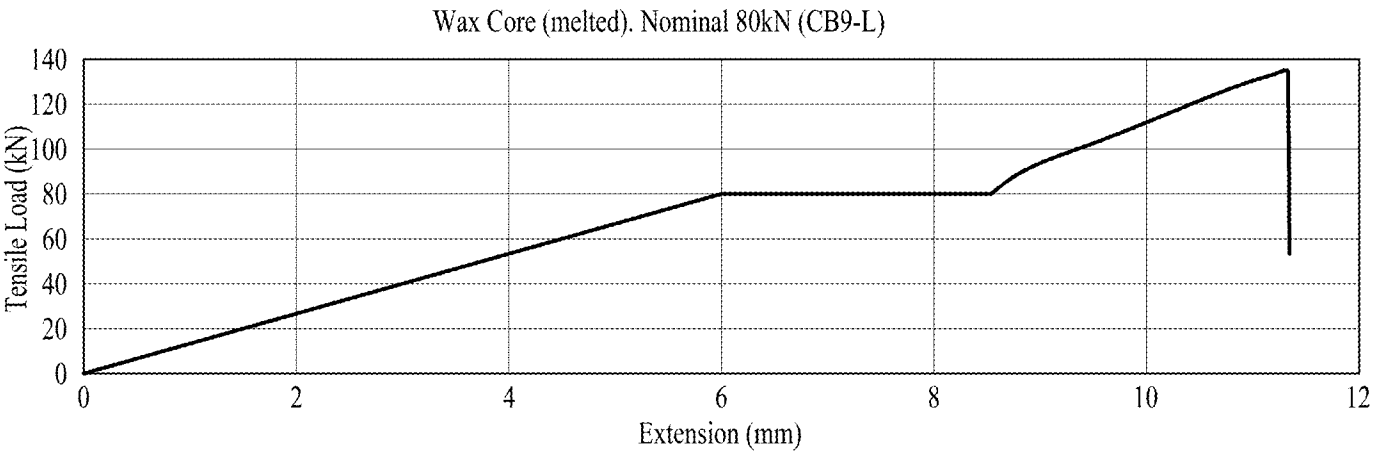
FIG. 39 illustrates a plot of tensile test for Carbolt CB9-L (wax core)

FIG. 39 illustrates a plot of Extension against tensile load. While not achieving the ultimate strength expected based on the number of tows due to the uneven strand tensions as already discussed, the plot does demonstrate the intended behavior of the Carbolt whereby at a predetermined load, 80 kN in the demonstration trial plotted, the Carbolt undergoes a known extension. This can be engineered to occur well before reaching its ultimate strength and then if the load increases further it eventually fails.

CONCLUSION

For single tows, the full carbon fiber strength, as specified by the manufacturer, could be achieved when using a high extension (~130%) epoxy resin. When four strands of tow were combined the strength was reduced by 15-30% which is indicative of uneven tension in the tow strands, a risk when forming by hand and not seen in commercial pultrusion. The strength reduction in twisted 4 ply was of the same order (19-32%) indicating that the twisting was not impacting significantly on the overall tensile strength. The same fluctuations in the pre-tension of different strands caused by variations in the manual manufacturing process prevented the full Carbolt from achieving the desired load capacity. Nevertheless, it can be extrapolated that an industrially produced Carbolt at 510 g/m (with a resin fraction of 60%) and 25 mm diameter could have a strength in excess of 400 kN (40 tons).

The Carbolt was found to be able to withstand significant shear forces. Due to its flexibility, it was able to deform under test, undergoing a displacement of 30 mm before the shear test box ran out of travel. Further, the ductile behavior, required to release the load stresses in the roof, was demonstrated with a Carbolt containing a modified core.

Twisting significantly longer carbon strands would allow uniform tension to be maintained in all carbon filaments during the twisting and cable forming phases to be achieved, as is routinely done in the commercial production of technical ropes and cables. This would then enable the Carbolt to achieve the tensile and shear strengths desired while retaining good ductile properties Interpretation As used herein, the term "exemplary" is used in the sense of providing examples, as opposed to indicating quality. That is, an "exemplary embodiment" is an embodiment provided as an example, as opposed to necessarily being an embodiment of exemplary quality.

It should be appreciated that in the above description of exemplary embodiments of the invention, various features of the invention are sometimes grouped together in a single embodiment, FIG., or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as falling within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

The invention claimed is:

1. A carbon fiber rock bolt including:

an outer carbon fiber rope comprising a series of tow fibers;

an inner core material; and wherein as the tension on the rock bolt increases beyond a predetermined limit, the inner core material undergoes a spatial compression wherein said inner core includes a honeycomb like structure having a series of cavities.

2. A carbon fiber rock bolt as claimed in claim 1, wherein said carbon fiber rope is impregnated with a high extension resin.

3. A carbon fiber rock bolt as claimed in claim 2, wherein the degree of extension of the resin is at least 20%.

4. A carbon fiber rock bolt as claimed in claim 3, wherein the degree of extension of the resin is about 130%.

5. A carbon fiber rock bolt as claimed in claim 1, wherein said carbon fiber rope includes at least one pressure sensitive optical fiber axially formed in the rope.

6. A carbon fiber rock bolt as claimed in claim 1, wherein the fiber is anchored to a surface using one of a resin capsule, pumpable resin or a mechanical anchor.

7. A carbon fiber rock bolt as claimed in claim 1, further including a tensioning member at one end.

8. A carbon fiber rock bolt as claimed in claim 7, wherein said tensioning member includes one of a torque tensioning member, a hydraulic ramp, a rig mast or cable drum arrangement, or an expandable foam or core.

9. A carbon fiber rock bolt as claimed in claim 1, wherein said cable is terminated using either an encapsulation sleeve or socket arrangement, a wedge locking arrangement, a swaged sleeve or thimble arrangement, or a wire grip type member.

10. A carbon fiber rock bolt as claimed in claim 1, wherein the direction of twist of adjacent carbon fiber filaments is alternated.

* * * * *